US010605420B2

(12) United States Patent
Eberts et al.

(10) Patent No.: US 10,605,420 B2
(45) Date of Patent: Mar. 31, 2020

(54) LIGHTING FIXTURE

(71) Applicant: Hunter Industries, Inc., San Marcos, CA (US)

(72) Inventors: Carl A. Eberts, Solana Beach, CA (US); Darrin I. Schmuckle, Vista, CA (US)

(73) Assignee: Hunter Industries, Inc., San Marcos, CA (US)

( * ) Notice: Subject to any disclaimer, the term of this patent is extended or adjusted under 35 U.S.C. 154(b) by 1 day.

(21) Appl. No.: 15/946,015

(22) Filed: Apr. 5, 2018

(65) Prior Publication Data

US 2018/0313504 A1 Nov. 1, 2018

Related U.S. Application Data

(60) Provisional application No. 62/491,658, filed on Apr. 28, 2017.

(51) Int. Cl.

| | |
|---|---|
| ***F21S 8/08*** | (2006.01) |
| ***F21V 17/12*** | (2006.01) |
| ***F21V 17/18*** | (2006.01) |
| ***F21V 15/01*** | (2006.01) |
| ***F21V 15/015*** | (2006.01) |
| ***F21V 21/02*** | (2006.01) |
| ***F21V 23/06*** | (2006.01) |
| ***F21W 131/10*** | (2006.01) |

(52) U.S. Cl.

CPC ..... *F21S 8/083* (2013.01); *F21V 15/01* (2013.01); *F21V 15/013* (2013.01); *F21V 15/015* (2013.01); *F21V 17/12* (2013.01); *F21V 17/18* (2013.01); *F21V 21/02* (2013.01); *F21V 23/06* (2013.01); *F21W 2131/10* (2013.01)

(58) Field of Classification Search

CPC ..... F21S 8/083; F21V 15/01; F21V 15/013; F21V 15/015; F21V 17/12; F21V 17/18; F21V 21/02; F21V 23/06; F21W 2131/10

See application file for complete search history.

(56) References Cited

U.S. PATENT DOCUMENTS

| | | | | |
|---|---|---|---|---|
| 3,679,886 | A * | 7/1972 | Pizzey | F21S 8/083 362/100 |
| 5,829,913 | A * | 11/1998 | Puckett | E01F 9/61 404/6 |
| 2007/0008717 | A1* | 1/2007 | Flaherty | F21S 8/033 362/153 |
| 2008/0273333 | A1* | 11/2008 | Berns | F21S 8/083 362/294 |
| 2012/0314429 | A1* | 12/2012 | Plunk | F21V 17/105 362/374 |
| 2014/0362564 | A1* | 12/2014 | Giblett | F21S 9/035 362/183 |

* cited by examiner

*Primary Examiner* — Mary Ellen Bowman
(74) *Attorney, Agent, or Firm* — Knobbe Martens Olson & Bear, LLP

(57) ABSTRACT

Lighting fixtures can have installation and mounting features that reduce the number of mounting screws that are readily visible or accessible from outside the lighting fixture. The lighting fixture can have an elongate housing, one or more light modules, first and second installation brackets, a plurality of J-bolts, and a cover. The only fastener(s) accessible from outside the housing of the lighting fixture can be one or more cover screws for securing the cover to the housing. The cover screw(s) can be positioned in inconspicuous locations and are not visible in plain view.

23 Claims, 42 Drawing Sheets section 11-11

Section 14B-14B

Section 14D-14D

LIGHTING FIXTURE

CROSS-REFERENCE TO RELATED APPLICATION

This application claims benefit under 35 U.S.C. 119(e) to U.S. Provisional Patent App. No. 62/491,658, filed Apr. 28, 2017, the entire disclosure of which is hereby incorporated by reference herein in its entirety. Any and all priority claims identified in the Application Data Sheet, or any corrections thereto, are hereby incorporated by reference under 37 CFR 1.57.

FIELD OF THE DISCLOSURE

The present disclosure relates to lighting fixture for illuminating an open or enclosed space. In particular, the present disclosure relates to bollard lights for illuminating a pathway, and/or landscape.

BACKGROUND

Bollard lights can illuminate and accent landscaping, walkways, buildings and/or parking areas. Bollard lights can add ambient lighting to property. Bollard lights can also improve security by marking pathways and driveways.

Bollard lights are typically installed in a concrete slab or foundation. Prior to installation, a hole can be dug in a selected installation site. Concrete or cement can be poured into the hole to form the foundation.

SUMMARY

The plurality of screws or other fasteners (e.g., clips, clamps, latches, rivets, etc.) used to assemble a bollard light and to secure the light fixture to the mounting base are typically exposed. The exposed screws are easily accessible, making the bollard lights susceptible to being tampered with. The exposed screws can also be unsightly and make the lighting fixture less aesthetically pleasing. Exposing the screws to rain, irrigation water, dust, dirt, and the like, can result in rust formation and cause fast deterioration of the stability of the lighting fixture.

The present disclosure provides lighting fixtures that reduce the number of fasteners that are accessible from outside the lighting fixture. In addition, the present disclosure also provides lighting fixtures in which the exposed screw(s) are installed in an inconspicuous manner and location such that the exposed screw(s) would not be readily visible to most viewers. Accordingly, the lighting fixtures according to some embodiments of the present disclosure are less susceptible to being tampered with, can shield some or all fasteners from the elements of nature, and have a sleeker and aesthetically pleasing outer appearance with no readily visible screws.

The present disclosure provides a lighting fixture. The lighting fixture can comprise an elongate housing having a first end and a second end; a first mounting bracket configured to be secured at or near the first end of the elongate housing with fasteners located internal to the elongate housing; a second mounting bracket configured to be secured at or near the second end of the elongate housing with fasteners located internal to the elongate housing; at least one light module configured to be housed within the elongate housing; and a cover configured to be secured to the elongate housing by at least one cover fastener, the cover blocking access to an interior of the elongate housing from the second end, wherein when the lighting fixture is installed, access to the interior of the elongate housing through the first end of the elongate housing can be blocked by a mounting surface. The elongate housing can comprise a window configured for emitting light from the at least one light module. The cover fastener can be configured to enter the elongate housing from behind the window such that the at least one cover fastener is hidden from plain view when a viewer's line of sight is above the at least one light module. The at least one cover fastener can be the only fastener accessible from outside the elongate housing. The lighting fixture can comprise one or more elongate locking screws configured to prevent rotation of the elongate housing relative to the mounting surface, the one or more elongate locking screws at least partially spanning a length of the elongate housing. The lower mounting bracket can be mechanically secured, without additional fasteners, to the mounting surface via an installation base bolted to the mounting surface. The at least one cover fastener can be configured to lock the cover and the at least one light module to the elongate housing. The first and second mounting brackets can be configured to be slidable within the elongate housing along a length of the elongate housing. The cover can comprise one or more retention members configured to engage the second mounting bracket. Each of the one or more retention members can be a retaining clip on an internally-facing side of the cover. The lighting fixture can comprise two or more light modules.

The present disclosure provides a lighting fixture. The lighting fixture can comprise an elongate housing having a first end and a second end; at least one light module, the elongate housing configured to house the at least one light module, the elongate housing further comprising a non-transparent material and a light-transmissive window configured for emitting light from the at least one light module; a first mounting bracket configured to be secured at or near the first end of the elongate housing by fasteners located within the elongate housing, wherein the first mounting bracket secured to the elongate housing is configured to be rotationally secured to an installation base; a second mounting bracket configured to be secured at or near the second end of the elongate housing by fasteners located within the elongate housing; one or more elongate locking screws configured to prevent rotation of the elongate housing relative to a mounting surface, the one or more elongate locking screws spanning at least partially a length of the elongate housing; and a cover configured to be secured to the second side of the elongate housing by at least one cover fastener so as to block access to an interior of the elongate housing from the second side of the elongate housing, wherein when the lighting fixture is installed, access to the interior of the elongate housing from the first end of the elongate housing can be blocked by a mounting surface. The cover fastener can be configured to enter the elongate housing from behind the window. The at least one cover fastener can be the only fastener accessible from outside the elongate housing.

The present disclosure provides a method of assembling a lighting fixture, the lighting fixture having one or more mounting fasteners accessible from outside a housing of the lighting fixture and not readily visible to a viewer, the housing having first and second ends. The method can comprise securing a first mounting bracket to a flat mounting surface; using fasteners located internal to the housing, securing the housing to the first mounting bracket at or near the first end of the housing so as to block access to an interior of the housing from the first end; sliding at least one light module inside the housing; using fasteners located internal to the housing, securing a second mounting bracket to the housing; using a cover to block access to the interior of the housing from the second end of the housing; and using at least one cover fastener, securing the cover to the housing from outside the housing. The at least one cover fastener can be the only fastener accessible from outside the elongate housing. Using the cover to block access to the interior of the housing from the second end can comprise engaging one or more retaining clips on an under side of the cover with corresponding one or more indents on the second mounting bracket. The method can comprise using at least one cover fastener, securing the light module to the housing. The method can comprise sliding two or more light modules into the housing.

All of these embodiments are intended to be within the scope of the disclosure herein. These and other embodiments will become readily apparent to those skilled in the art from the following detailed description having reference to the attached figures, the disclosure not being limited to any particular disclosed embodiment(s).

BRIEF DESCRIPTION OF THE DRAWINGS

These and other features, aspects, and advantages of the present disclosure are described with reference to the drawings of certain embodiments, which are intended to schematically illustrate certain embodiments and not to limit the disclosure.

DETAILED DESCRIPTION

Although certain embodiments and examples are described below, those of skill in the art will appreciate that the disclosure extends beyond the specifically disclosed embodiments and/or uses and obvious modifications and equivalents thereof. Thus, it is intended that the scope of the disclosure herein disclosed should not be limited by any particular embodiments described below.

Figure 1:
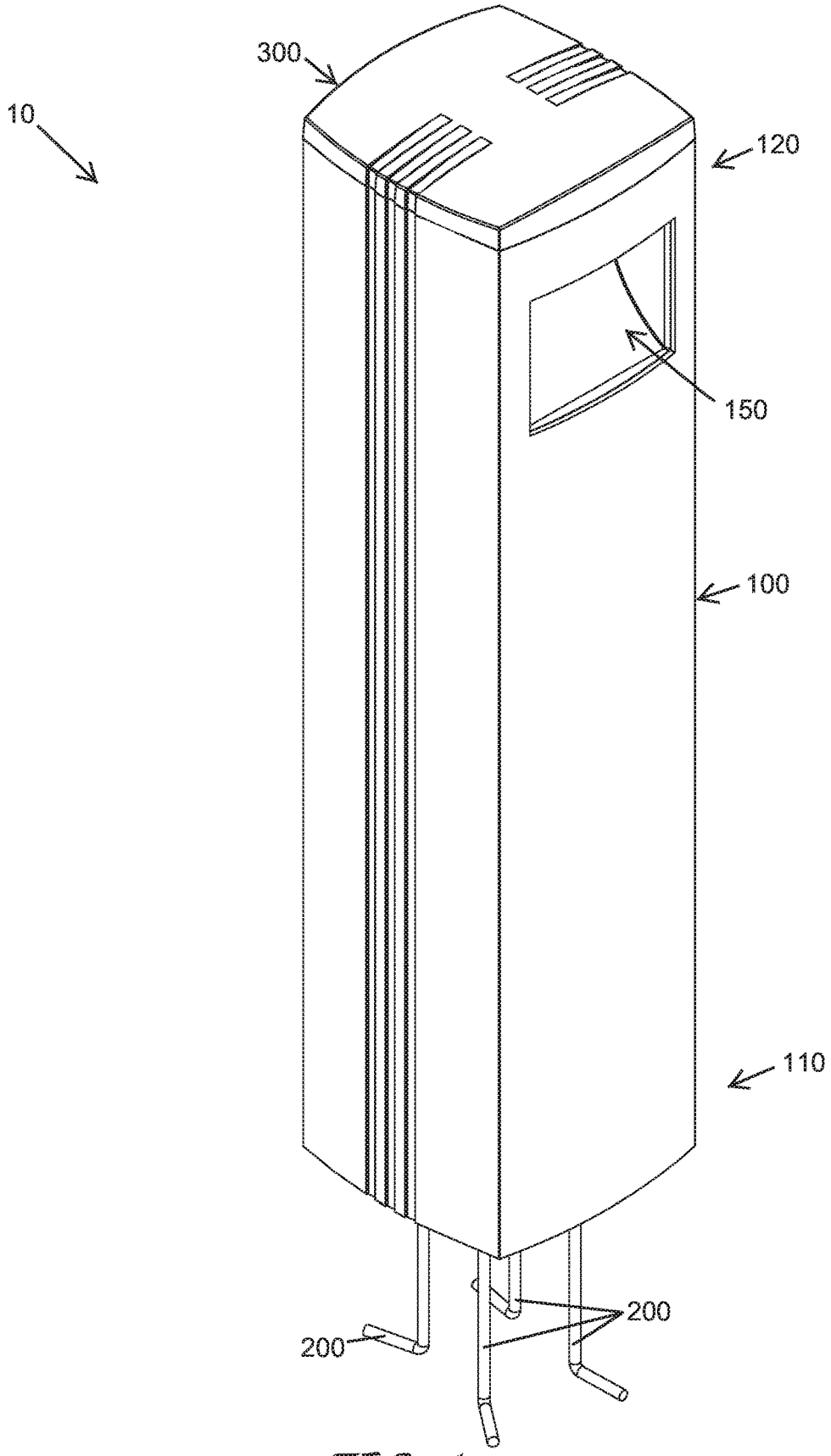
FIG. 1 illustrates a perspective view of an assembled example lighting fixture.
Figure 2:
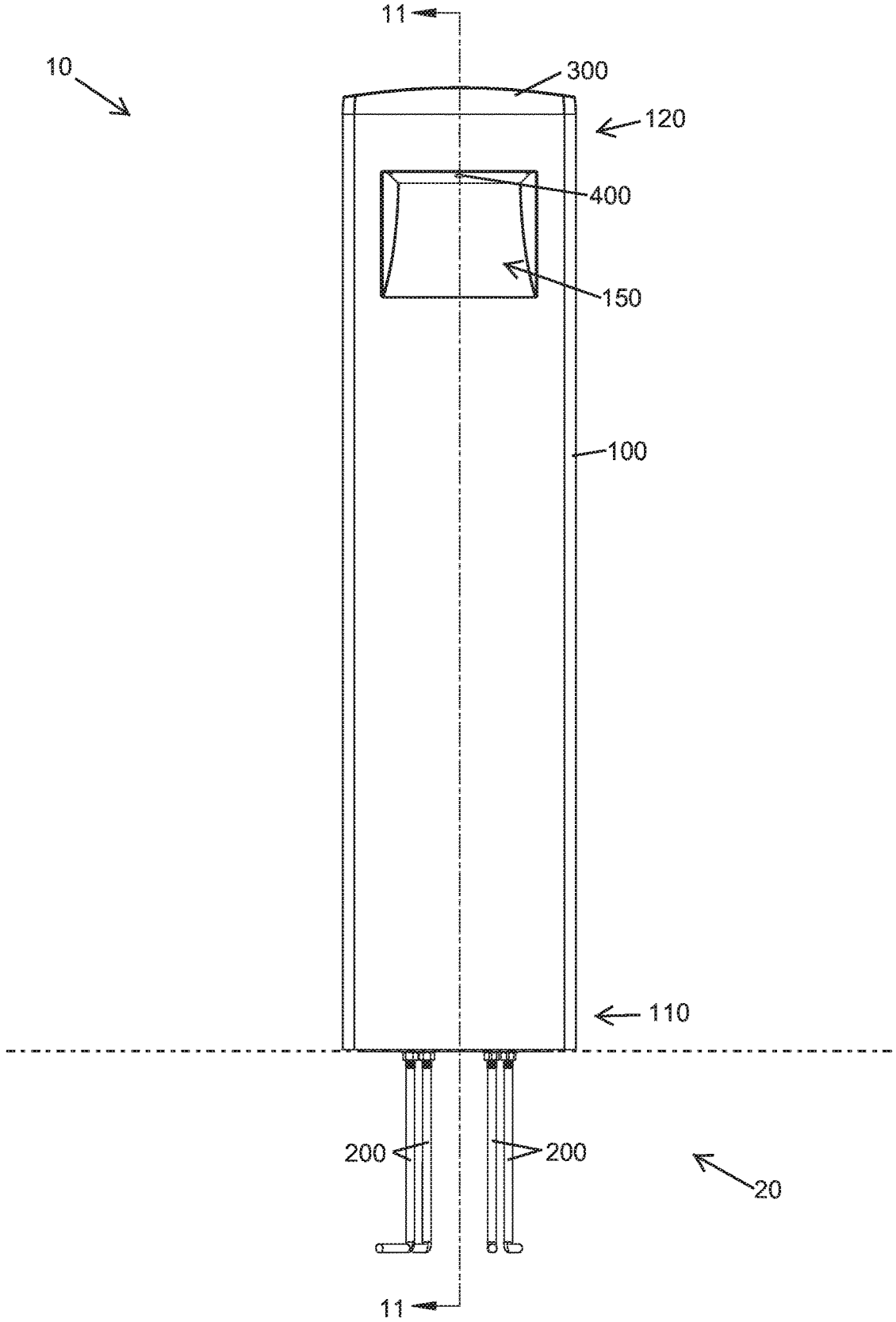
FIG. 2 illustrates schematically a front view of an example lighting fixture that is installed to a mounting surface.

The present disclosure provides lighting fixtures with installation and mounting features that reduce the number of mounting screws that are visible or accessible from outside the lighting fixture. FIGS. 1 and 2 illustrate an example assembled lighting fixture 10 with an elongate housing 100 and a cover 300. Although the lighting fixture 10 is illustrated as being installed in an upright position and installation processes of the lighting fixture 10 will be described herein relative to a level mounting surface, such as the ground, the lighting fixture 10 described herein is configured to be installed in other positions. For example, the lighting fixture 10 can be installed horizontally against a vertical wall, on a slope in an angled orientation, or vertically downward from a ceiling.

Overview of Example Lighting Fixtures

As shown in FIGS. 1 and 2, the elongate housing 100 can have a first end 110 and a second end 120 that is opposite the first end 110 along a length of the elongate housing 100. The first and second ends 110, 120 can be open. The length of the housing 100 can vary based on the intended use of the lighting fixture 10. The elongate housing 100 can have a substantially rectangular or square transverse cross-section, as shown in FIGS. 1 and 2, or any other transverse cross-sectional shapes, including but not limited to a circular or any polygonal cross-sections. The first end 110 of the elongate housing 100 can be operably coupled to a plurality of J-bolts 200 in order to be mounted to an installation location (described in greater detail with reference to FIGS. 4-8B below). The second end 120 of the elongate housing 100 can be coupled to the cover 300. The cover 300 can cover the open second end 120 of the housing. The elongate housing 100 can have one or more windows 150 configured to emit light from one or more light modules (shown in FIG. 3) housed in an interior of the housing 100. FIGS. 1 and 2 illustrate one rectangular window 150 being positioned on a wall of the elongate housing 100 nearer to the second end 120 than to the first end 110 of the elongate housing. Shape, height and number of the window 150 are not limiting. The elongate housing 100 can be made of extruded and/or stamped metal (e.g., aluminum, steel, etc.), molded plastic, or other suitable materials based on the disclosure herein. The elongate housing may not transmit light except through the window(s) 150. In some embodiments, the elongate housing 100 includes one or more transparent or translucent sections, apertures, or other structural features configured to permit light passage between the interior and exterior of the elongate housing 100. The window(s) 150 may be covered or sealed with a transparent or translucent material to prevent water (such as rain, irrigation water) and dirt from entering the interior of the housing 100. The window(s) 150 may be sealed or substantially sealed by the light module after the light module is installed inside the housing 100.

The elongate housing 100 can have a generally smooth outer surface. The elongate housing 100 may have decorative features on the outer surface. Details of the interior of the elongate housing 100 will be described with reference to FIGS. 8A-8B below. The decorative features on the outer surface can be used as indicators for functional features inside the elongate housing 100 to allow for easier orientation of the elongate housing 100 during installation.

FIG. 2 illustrates the lighting fixture 10 installed above a concrete slab or foundation 20. A hole can be dug in a mounting location, such as the ground. Concrete or cement can be poured into the hole to form the concrete slab or foundation 20. In some examples, the foundation 20 is poured into a mold at least partially positioned above ground. The plurality of J-bolts 200 can be installed in concrete or cement before the concrete or cement is cured. The plurality of J-bolts 200 can be installed free of the rest of the lighting fixture 10, which can be coupled to the J-bolts 200 after the J-bolts 200 have been fixedly installed in the cured concrete slab or foundation 20. After the concrete is cured, a top surface of the concrete slab or foundation can form a mounting surface for the rest of the lighting fixture 10.

FIG. 2 also illustrates a cover screw 400 installed in an inconspicuous location. The cover screw 400 can enter the housing 100 from behind a side of window 150 closer to the second end 120 of the housing and be secured to the cover 300. Further, only a small screw head of the cover screw 400 is exposed, whereas a threaded portion of the cover screw 400 is substantially advanced into the housing 100 and/or the cover 300. Unless the viewer is looking directly onto that side of the window 150 (e.g., from a position level with or closer to the first end 110 than the window 150), the screw head of the cover screw 400 is not readily visible to the viewer. For example, as shown in FIGS. 1 and 2, when a viewer's line of sight is at or above the window 150 (e.g., in the orientation of FIGS. 1 and 2), the cover screw 400 is blocked from the view's line of sight by the housing 100. If the light in the light module is switched on, the glare from the light can also inhibit or prevent the viewer from seeing the cover screw 400 even if the viewer looks in the direction of the cover screw 400. Therefore, as shown in FIGS. 1 and 2, when installed, the lighting fixture 10 can have a sleek outer appearance, with no apparently visible fasteners/screws.

The cover screw 400 can have a customized screw head that can only be removed with a specialized tool, or require excessive or disruptive force if an attempt is made to unscrew the cover screw 400 using an off-the-shelf screw driver. The customized screw head can further reduce the likelihood of tampering of the lighting fixture 10. In addition, the fasteners located internal to the housing 100 can be off-the-shelf screws and nuts with standard sizes, thereby reducing the cost of the lighting fixture 10 and making it easy to replace the internal fasteners.

Installation and Interior Features of Example Lighting Fixtures

Installation of the lighting fixture 10 and its interior features will now be described.

First Subassembly

Figure 3A:
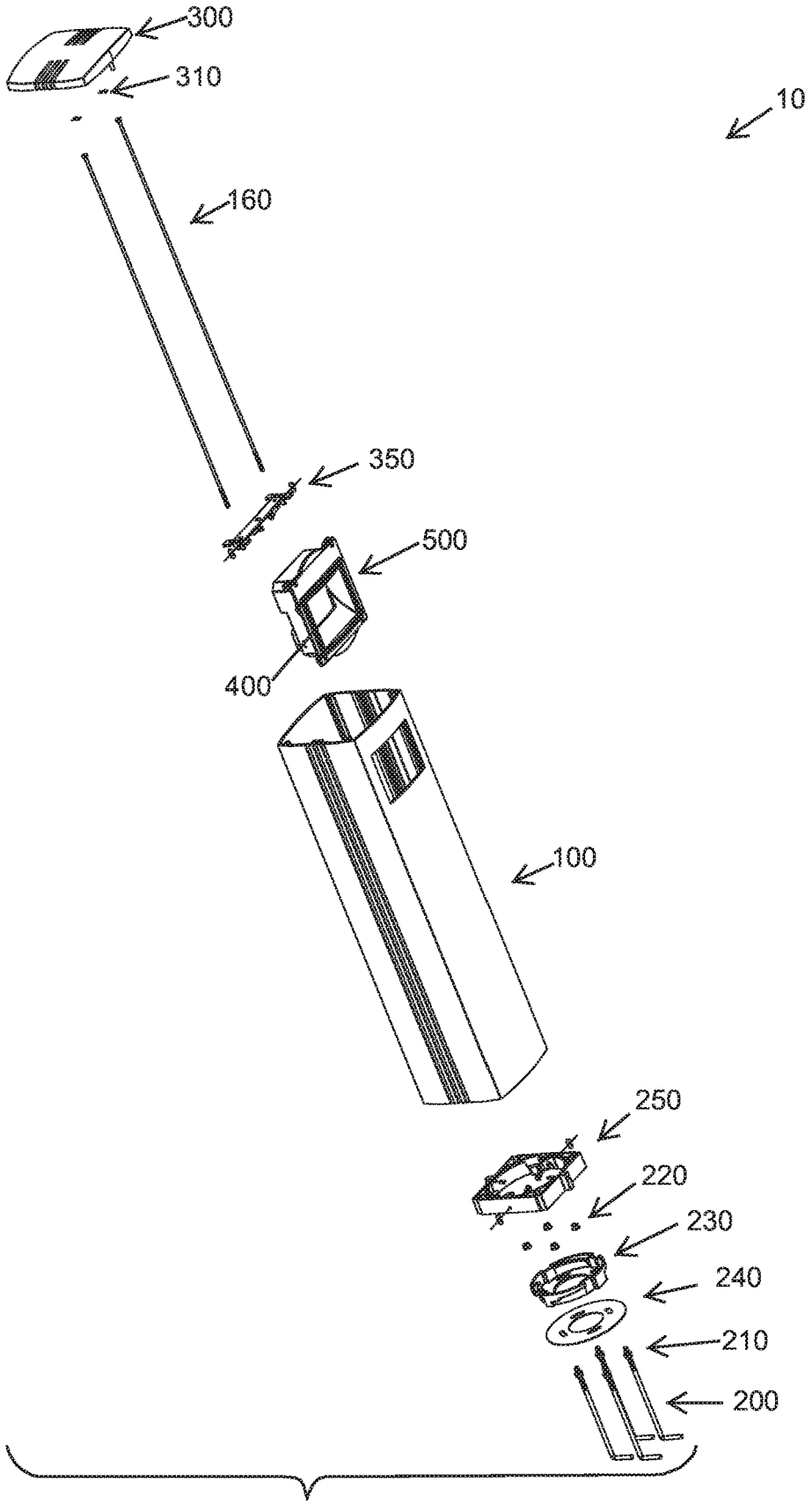
FIG. 3A illustrates an exploded perspective view of the lighting fixture of FIG. 1.
Figure 3B:
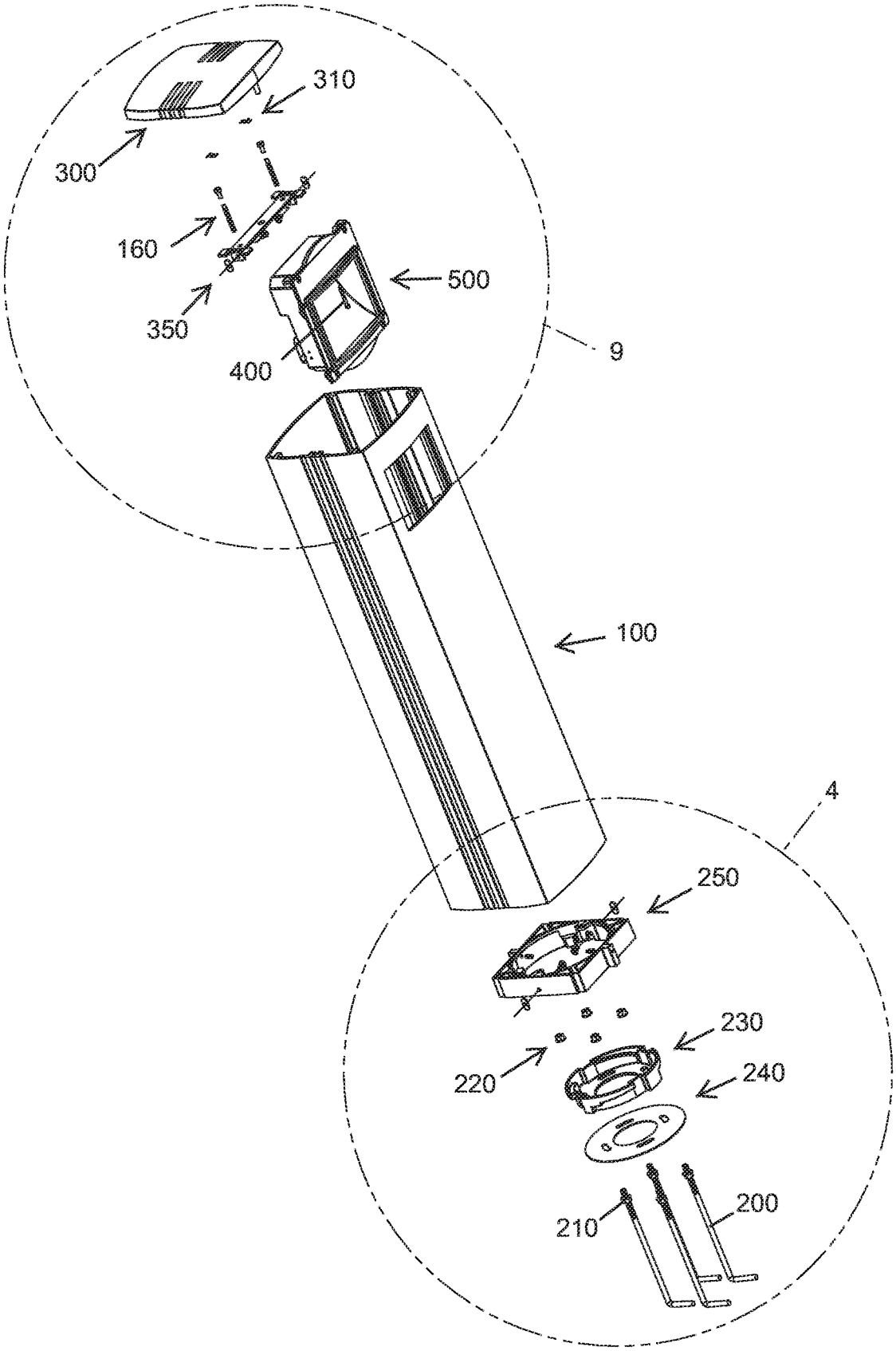
FIG. 3B illustrates another exploded perspective view of the lighting fixture of FIG. 1, with shortened locking screws for clarity.
Figure 4:
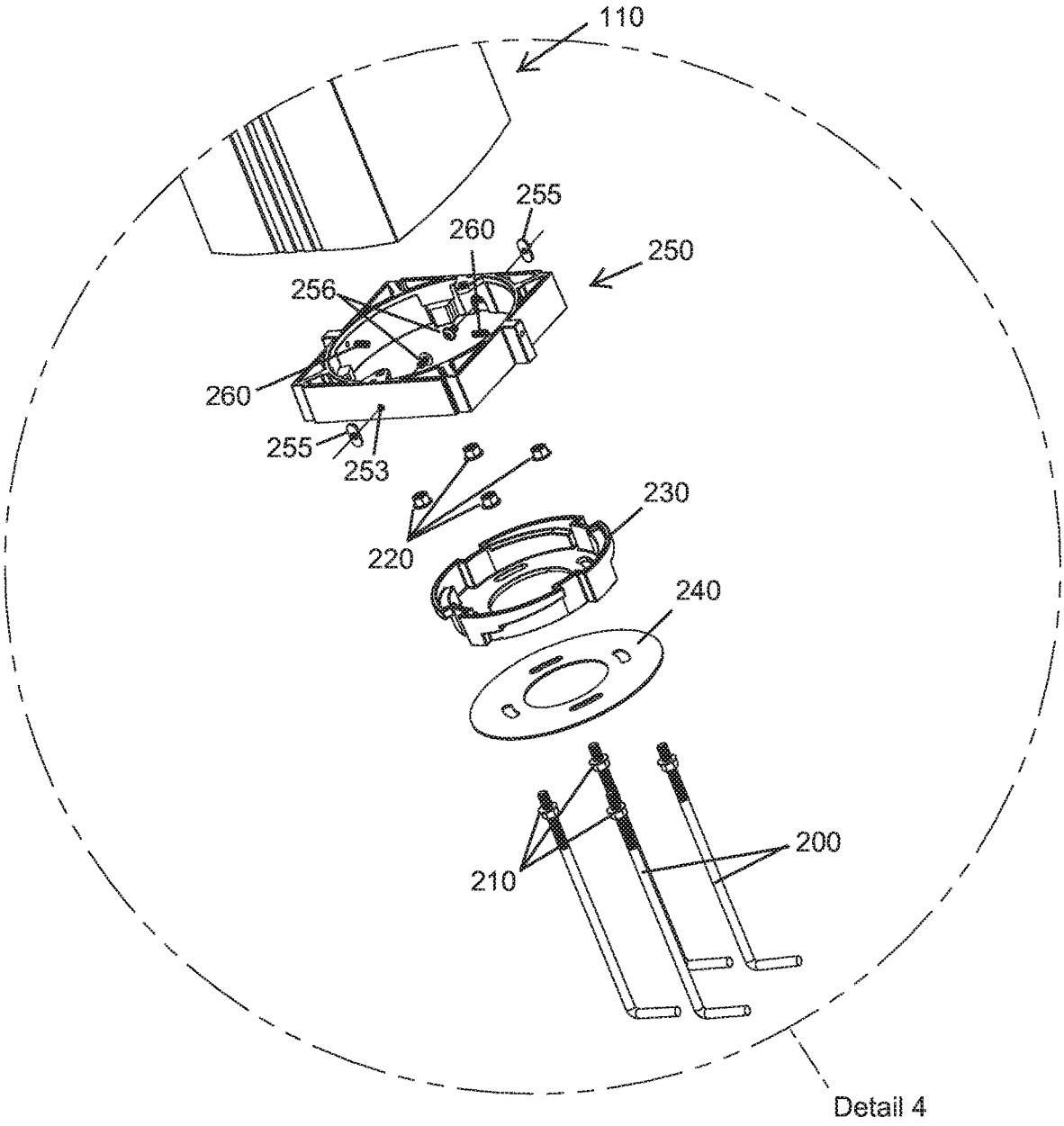
FIG. 4 illustrates a detailed exploded view of a first end of the lighting fixture of FIGS. 3A-B.

FIGS. 3A-B and 4 illustrate a first subassembly of the lighting fixture 10, which can include the first end 110 of the housing, a first mounting bracket 250, an installation base 230, the plurality of J-bolts 200 and/or installation nuts 220. The first mounting bracket 250 can be a lower mounting bracket. The first subassembly can optionally include an installation spacer 240 and a plurality of leveling nuts 210. The first subassembly can install the elongate housing 100 onto the concrete slab or foundation at the first end 110 of the elongate housing 100. After the plurality of J-Bolts 200 are embedded in the concrete slab or foundation, the installation base 230 can be secured onto a surface of the concrete slab or foundation.

Figure 5:
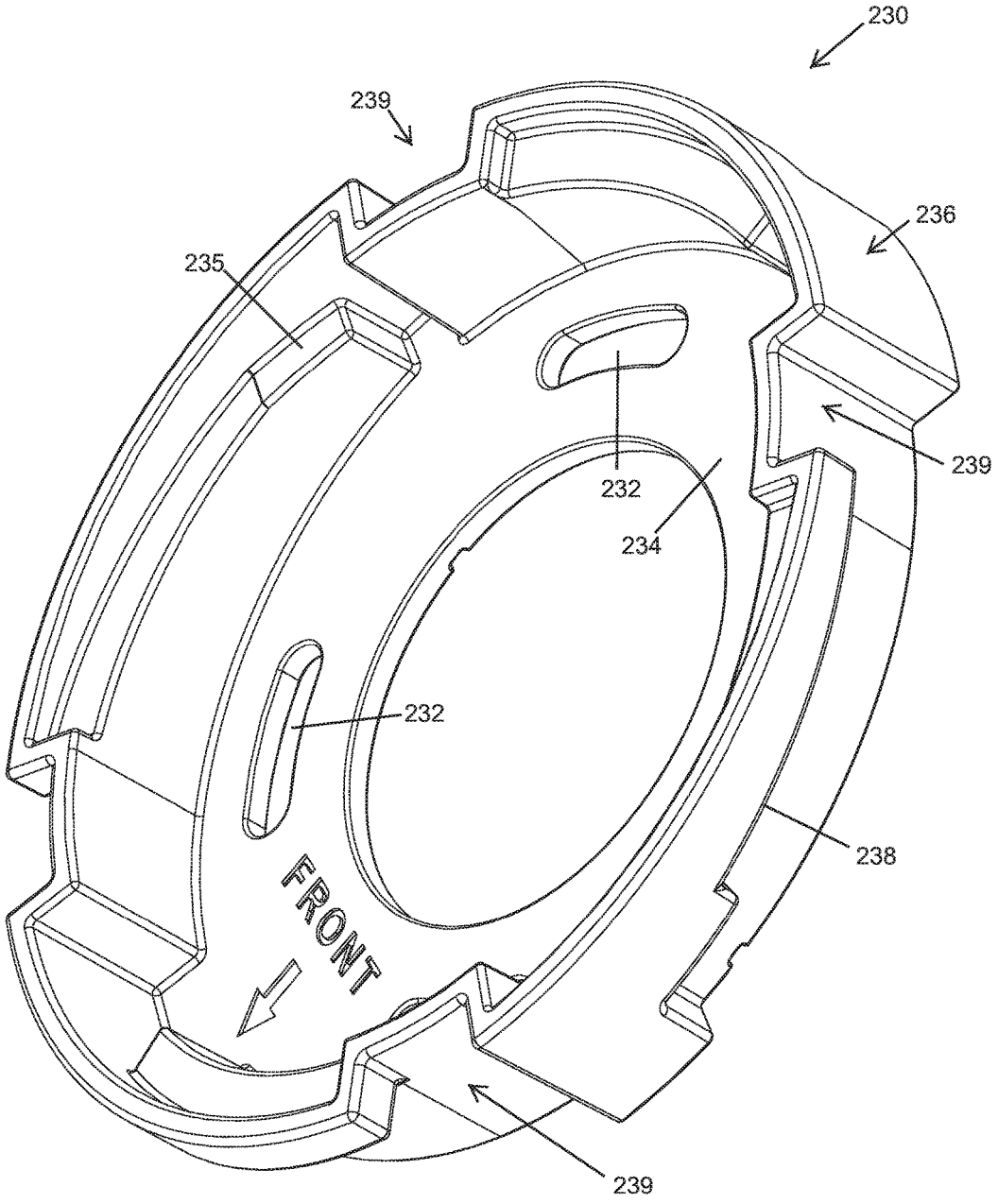
FIG. 5 illustrates a perspective view of an installation base of the lighting fixture.

FIG. 5 illustrates an example installation base 230, which can be a generally cylindrical flat disc 234. The installation base 230 can include a raised wall 236 extending from the perimeter of the disc 234 (e.g., extending from all or one or more portions of the perimeter of the disc 234). The disc 234 can have a plurality of slots 232. Each of the plurality of slots 232 can be sized to allow one or more J-bolts 200 to pass through. The plurality of installation nuts 220 can be tightened above the flat disc 234 of the installation base to fixedly clamp the installation base 230 onto the concrete slab or foundation. The flat disc 234 can optionally include installation instructions, such as indicator(s) of a front end of the installation base 230 to orient a user during installation.

Figure 6:
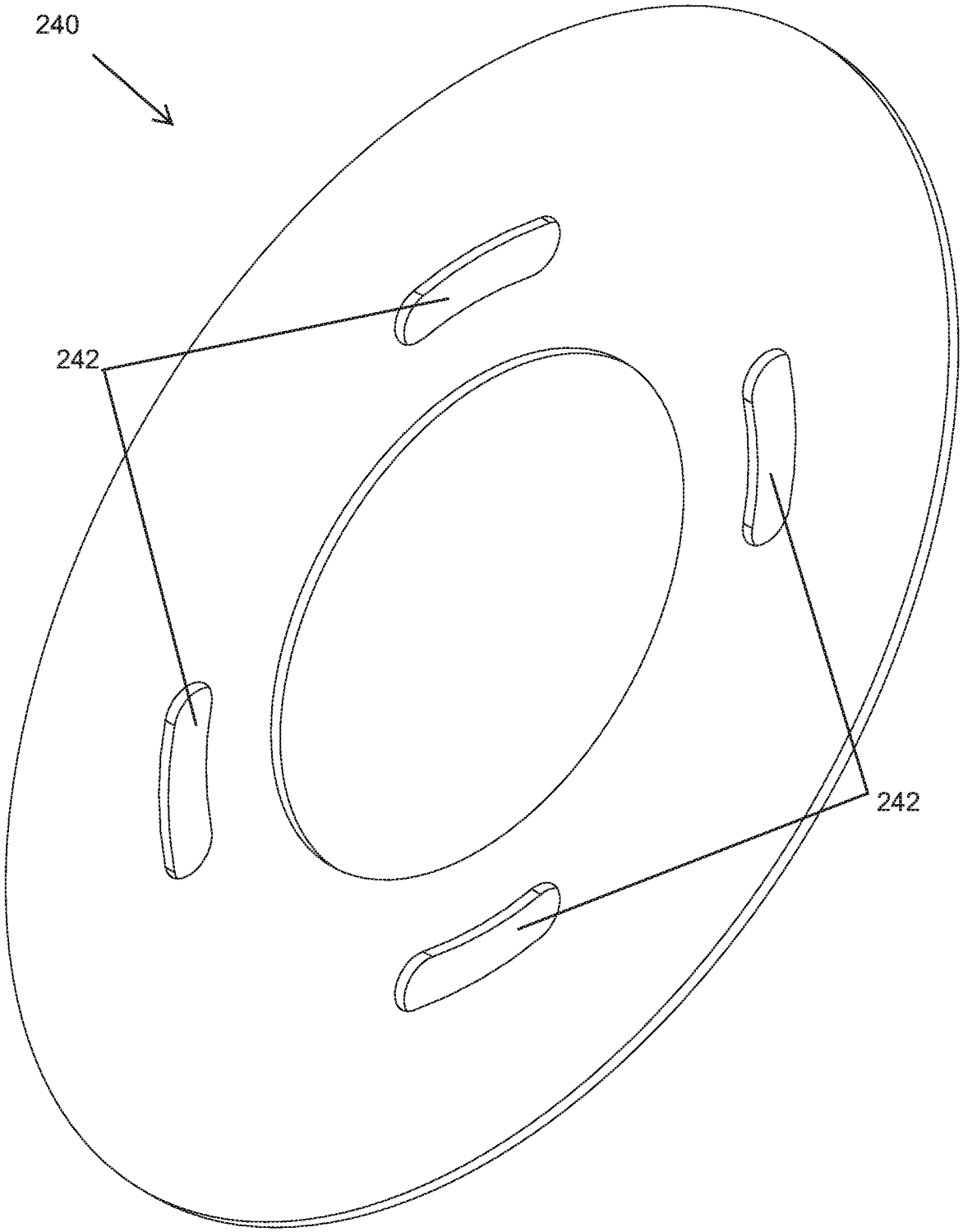
FIG. 6 illustrates a perspective view of an installation spacer of the lighting fixture.

The first subassembly can optionally include the installation spacer 240, shown in greater detail in FIG. 6, and the plurality of leveling nuts 210. The installation spacer 240 can have a plurality of slots 242 corresponding to the plurality of slots 232 on the installation base 230 for allowing the plurality of J-bolts 200 to pass through. Before installing the installation base 230, the installation spacer 240 can be placed above the concrete slab or foundation. The plurality of leveling nuts 210 can be placed below the installation spacer 240 before the concrete or cement is cured and adjusted to hold the installation spacer 240 level. In some instances, pockets or other voids may be formed in the concrete when it is wet to allow for the leveling nuts to be installed and or adjusted after the concrete has cured. In some embodiments or scenarios, the installation spacer 240 can be held level from above (e.g., from a side of the spacer 240 opposite the concrete or other slab/foundation material). The plurality of installation nuts 220 can then be tightened to fixedly clamp the installation base 230 onto the installation spacer 240. The installation spacer 240 and plurality of leveling nuts 210 can advantageously allow the installation base 230 to be level.

Figure 7:
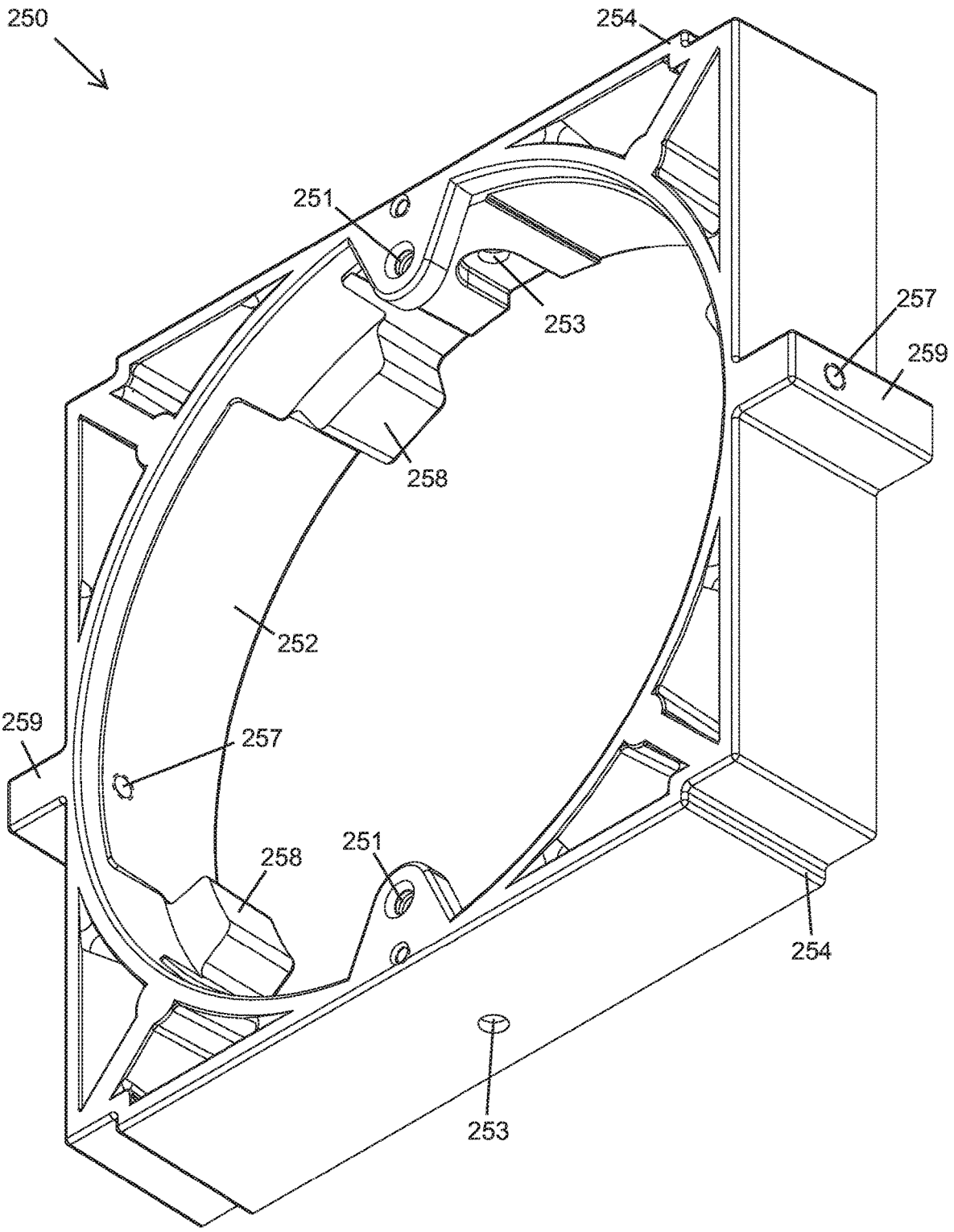
FIG. 7 illustrates a perspective view of a first mounting bracket of the lighting fixture.

Returning to FIG. 5, the wall 236 of the installation base 230 can have mechanical features for coupling with corresponding features on the first mounting bracket 250, shown in greater detail in FIG. 7. In some embodiments, coupling of the installation base 230 and the first mounting bracket does not require additional fasteners. For example, a bayonet mount or other mechanism can be used. Specifically, the wall 236 of the installation base 230 can have a plurality of cams 238. The plurality of cams 238 can each have an adjacent cam slot 239. Correspondingly, as shown in FIG. 7, the first mounting bracket 250 can have a generally circular inner wall 252. The mounting bracket 250 can include a plurality of locking tabs 258 projecting radially inward from the inner wall 252. The inner wall 252 and the plurality of locking tabs 258 of the first mounting bracket 250 are sized such that the plurality of locking tabs 258 can slide through the plurality of cam slots 239 of the installation base 230. Upon rotation of the first mounting bracket 250 relative to the installation base 230, for example, in a clockwise direction for the configuration shown in FIGS. 5 and 7, the plurality of cams 238 of the installation base 230 are sized to wedge the plurality of locking tabs 258 of the first mounting bracket 250 into the plurality of cams 238. As shown in FIGS. 5 and 7, four cams 238/cam slots 239 and four locking tabs 258 can be distributed about 90° from each other. Different numbers or distribution of the cams 238/cam slots 239 and corresponding locking tabs 258 can be used to achieve substantially the same locking function. In some embodiments, the orientation of the cam slots 239 and tabs 258 is reversed. For example, the first mounting bracket 250 can include radially-outward projecting tabs 258 configured to engage with radially-inward cam slots 239 on the installation base 230.

Advantages of a fastener-less connection between the installation base 230 and the first mounting bracket 250 include reduction in total number of parts of the lighting fixture 10, and/or simpler installation steps. In particular, the lower mounting bracket 250 can first be fixedly attached to the elongate housing 100, for example, near the first end 110 of the elongate housing 100, before the housing-first mounting bracket subassembly is rotated to a locking position on the installation base 230. In some embodiments, the lower mounting bracket 250 can be non-removably attached to the first end 110 of the elongated housing 100. In some embodiments, the lower mounting bracket 250 can be welded to the first end 110 of the elongated housing 100. In some embodiments, the lower mounting bracket 250 can be removably attached to the elongated housing 100. In some embodiments, fixing the first end 110 of the elongate housing 100 to the installation base 230 can help to align fastener holes for later installation steps. Such pre-alignment of fasteners holes can reduce difficulties of aligning features within the housing 100 with those of the first installation assembly Features for removably securing the first mounting bracket 250 to the elongate housing 100 will now be described with reference to FIGS. 4, 7 and 8A-8B. The first mounting bracket 250 can have an outer profile that is sized to be slidable within the elongate housing 100 along all or a portion of the length of the housing 100. For example, the outer profile of the mounting bracket 250 can be generally rectangular, square-shaped, oval-shaped or any other polygonal and/or curved shape.

Figure 8A:
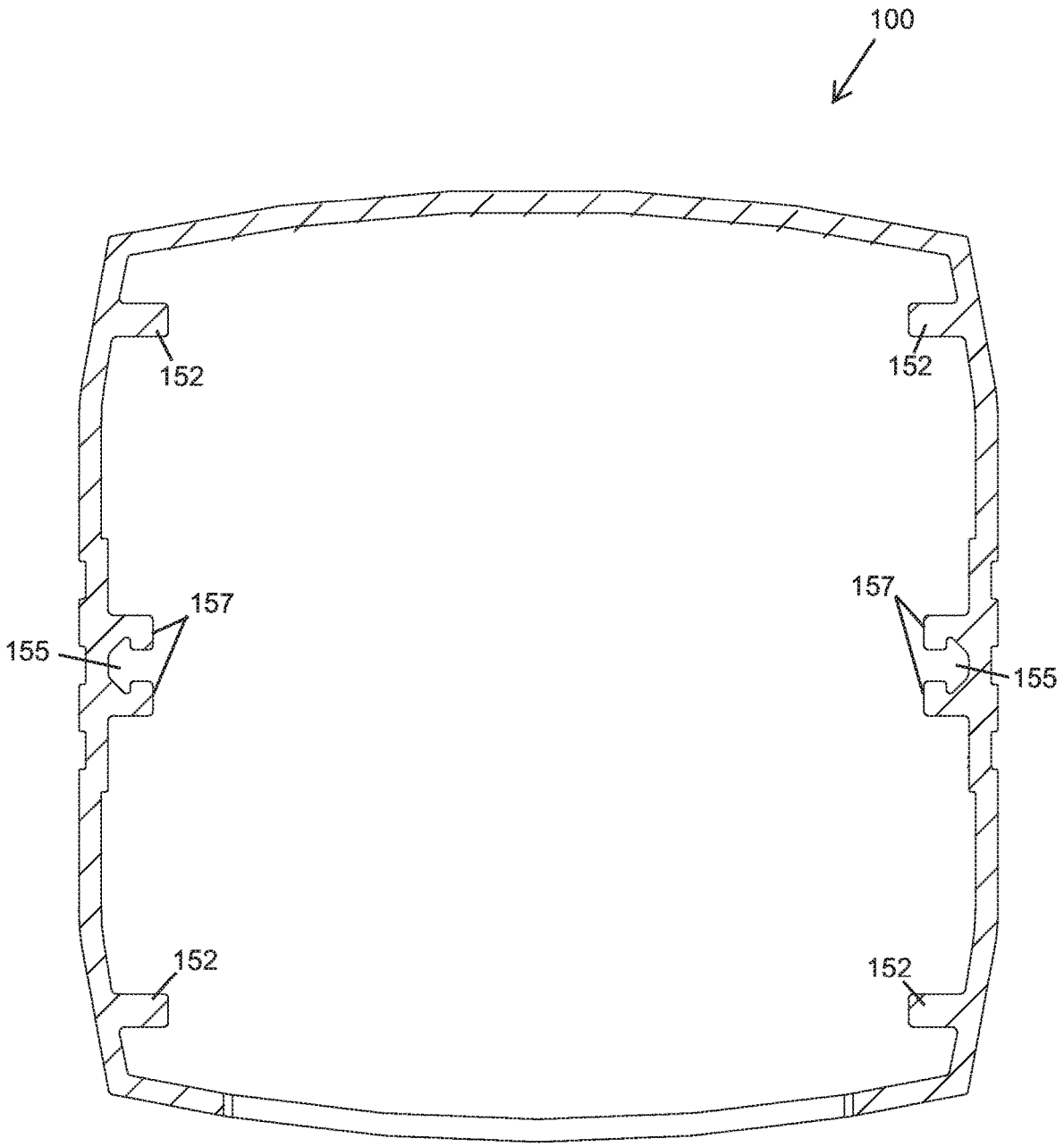
FIG. 8A illustrates a transverse cross-sectional view of a housing of the lighting fixture.
Figure 8B:
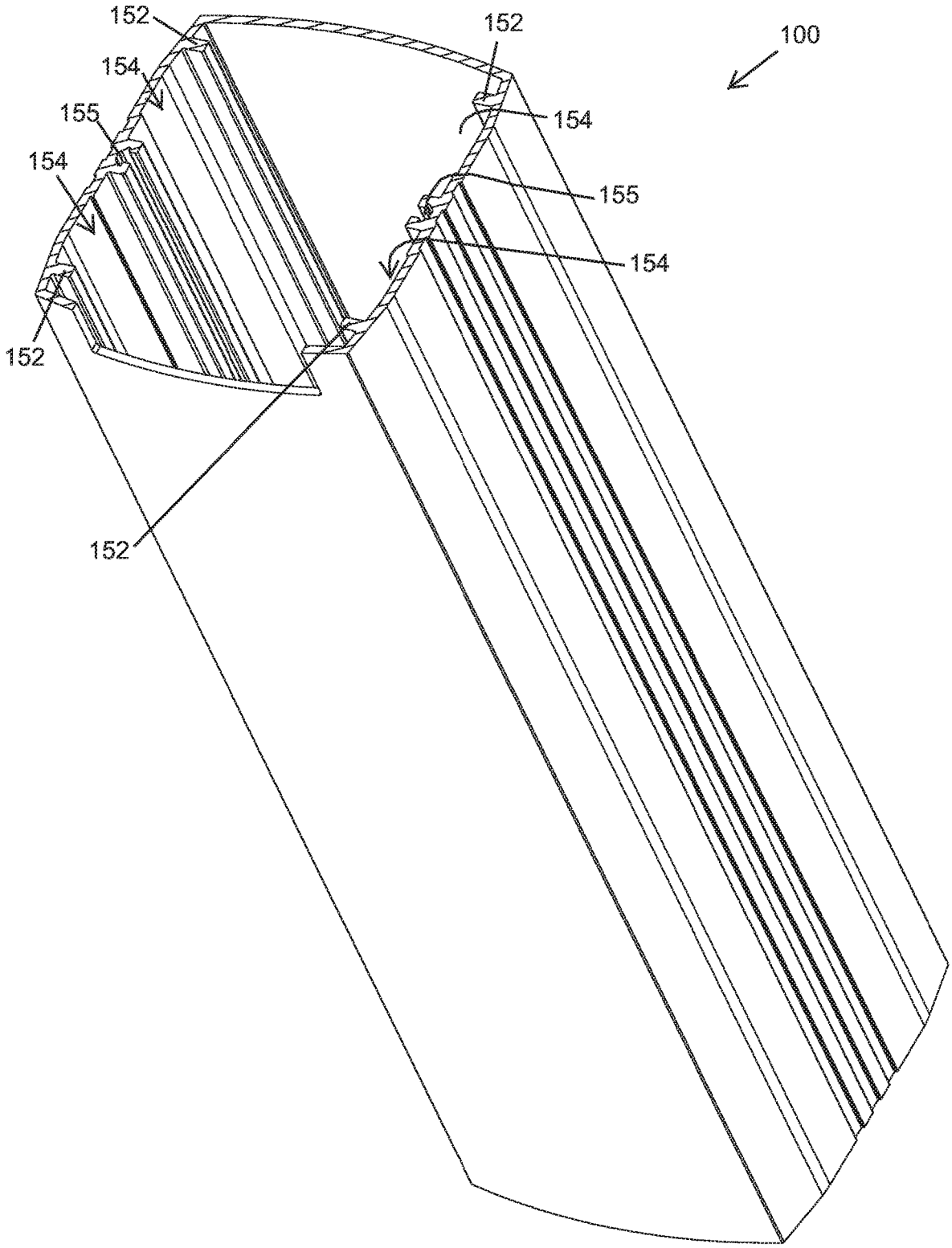
FIG. 8B illustrates a perspective partial view of the housing of FIG. 8A.

As shown in FIGS. 8A-8B, an inner wall of the elongate housing 100 can have one or more tracks, slots, or other structures extending along all or a portion of the length of the housing 100. The tracks can be configured to restrict rotational movement of components with respect to the housing 100 while allowing movement of those components along the length of the track(s). For example, one or more T-slots 155 can run along all or a portion of the length of the housing 100. In some embodiments, one or more tracks 154 are defined by one or more pairs of ribs 152 extending into the interior of the housing 100 on one or more sides of the housing 100. The tracks 154 can span the T-slots 155.

The one or more T-slots 155 can be sized to fit one or more first end mounting nuts 255 (FIG. 4) or other structures. The one or more T-slots 155 can each have an opening of a first width sized to fit the first end mounting nuts 255 and an opening of a narrower second width to accommodate a threaded portion of a first end mounting screw 256, but to prevent the first end mounting nut 255 from passing out of the T-slot 155 through the opening of the second width (e.g., in a direction perpendicular to the length of the housing 100). The one or more first end mounting screws 256 can be inserted through the one or more clearance holes 253 from the interior of the housing 100 and through the opening of the second width of the one or more T-slots 155 to engage the first end mounting nuts 255. The threaded engagement between the screws 256 and the nuts 255 can fixedly clamp the first mounting bracket 250 to ribs 157 defining the opening of the narrow width of the T-slot 155.

As shown in FIG. 7, the outer profile of the first mounting bracket 250 can have one or more protrusion 254 configured to slide along the one or more tracks 154 of the housing 100. The number, shape, dimension, and location of the tracks and protrusions are not limiting. FIG. 7 illustrates the clearance holes 253 through the sidewalls of the first mounting bracket 250. For example, the clearance holes 253 can be substantially near or at a mid-point of the one or more protrusions 254. FIGS. 8A-8B illustrate the T-slot 155 substantially at or near a midpoint of the one or more tracks 154. However, the number, location and dimension of the clearance hole and corresponding T-slots are not limiting.

FIG. 4 also illustrates another optional coupling feature for coupling the housing 100 with the first mounting bracket 250. The optional feature can be in the form of a plurality of set screws 260 configured to engage one or more threaded holes 257 on the circular inner wall 252 of the first mounting bracket 250. The plurality of set screws 260 can be advanced through the one or more threaded holes 257 from the interior of the housing such that the plurality of set screws 260 can be tightened to the inner wall of the housing 100. A radial force from each of the plurality of set screws 260 against the inner wall of the housing 100 can stabilize the first mounting rack 250 onto the elongate housing 100 in addition to or instead of the compressive force due to the first end mountings screw(s) 256 and nut(s) 255 with the T-slots 155. An outer wall of the first mounting rack 250 can have a protruding tab 259 for accommodating the threaded hole 257 so that the threaded hole 257 can have a sufficient length of for engaging the plurality of set screws 260. In some embodiments, the threaded hole(s) 257 of the mounting bracket 250 extend through one or more walls of the mounting bracket 250 without passing through a protrusion. FIG. 7 illustrates two protruding tabs 259, each with one threaded hole 257. The protruding tabs 259 are diametrically opposite each other and spaced about 90° from each of the clearance holes 253. However, the number and location of the threaded holes 257 are not limiting.

Second Subassembly

Figure 9:
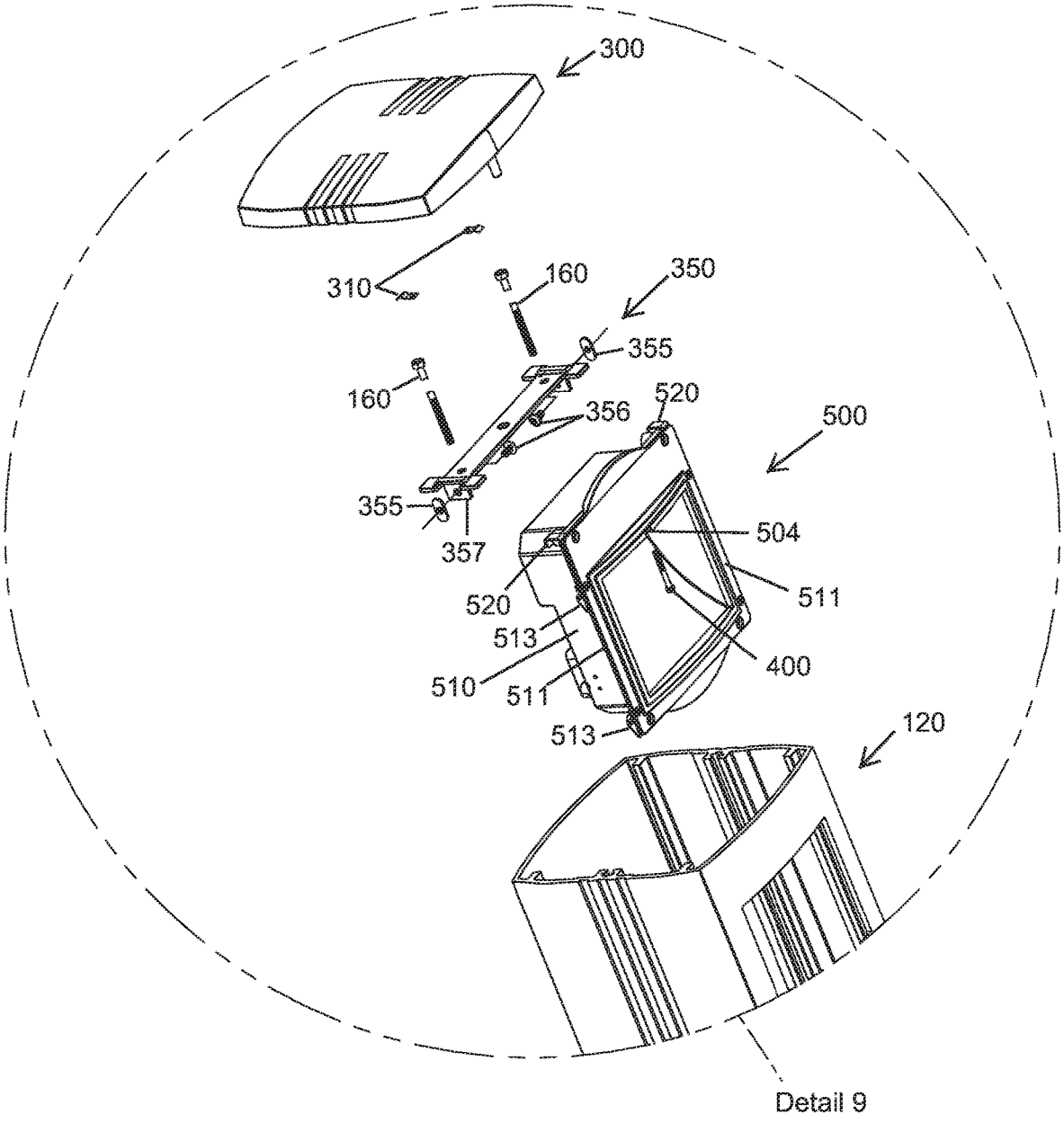
FIG. 9 illustrates a detailed exploded view of a second end of the lighting fixture of FIGS. 3A-B.

Turning to FIG. 9, a second subassembly of the lighting fixture 10 can include the second end 120 of the housing, a second mounting bracket 350, one or more light modules 500 and/or a cover 300. The second mounting bracket 350 can be an upper mounting bracket. The light module 500 can comprise one or more light sources (e.g., diodes, bulbs, etc.) and associated wiring and electronic components within a module housing 510. The light module 500 can include batteries for powering the light sources. In some embodiments, the light module 500 may be wired to a power source. The light sources can be exchangeable or replaceable so that different light sources can be used in the lighting fixture 10. The module housing 510 can be sized to fit within the elongate housing 100. As shown in FIG. 9, the light module 500 can have a length and a width configured for fitting the light module 500 into a portion (e.g., a half, a third, a fourth, or some other portion) of the interior of the housing 100 between the one or more T-slots 155 or the one or more ribs 152 on the same side as the T-slots 155. In some embodiments, the light module(s) 500 include one or more rails 511 configured to slidably engage with a portion of the housing 100 (e.g., with one or more of the ribs 152). In some embodiments, the light module(s) 500 include a pair of rails 511 on opposite sides of the light module housing 510. In some embodiments, a flexible spring clip 513 may be attached to each of the rails 511. In some embodiments, the spring clips 513 may engaged with the ribs 152 to force the light module 500 towards the window 150.

The light module(s) can be placed near or next to the window 150 of the housing to allow light from the light sources to emit through the window 150. Other shapes and dimensions of the light module 500 are possible (e.g., sizes and shapes wherein the module housing 510 can fit partially or entirely within the interior of the housing 100). The light module 500 can further have one or more hanging hooks 520, for example, one on each end of the length of the module housing 510. The one or more hanging hooks 520 can hook onto the ribs 152 after the light module 500 is placed within the housing 100 from the second end 120 of the housing so that the light module 500 can be hanging from the ribs 152 at or near the second end 120 of the housing. The one or more hanging hooks 520 can have a tight fit over the ribs 152 to stabilize the light module 500 within the housing 100. Other mechanisms for keeping the light module 500 inside the housing 100 at the same or similar height as the window 150 can be used based on the disclosure herein.

Figure 10:
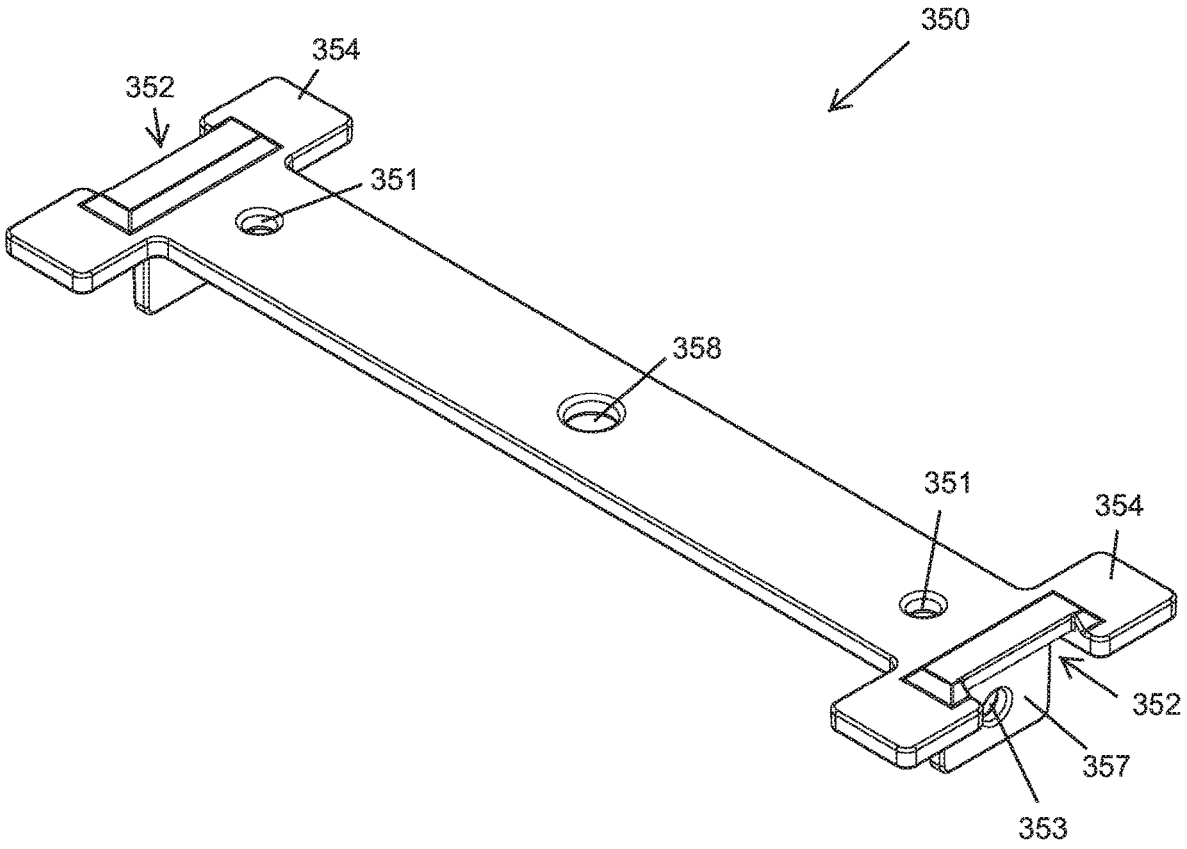
FIG. 10 illustrates a perspective view of a second mounting bracket of the lighting fixture.

FIG. 10 illustrates an example second mounting bracket 350. The second mounting bracket 350 can be in a form of an I-shaped beam of substantially the same length as a width of the interior of the housing 100. An overall shape of the second mounting bracket 350 is not limiting. The second mounting bracket 350 can be secured to the housing 100, for example, at or near the second end 120 of the housing, using one or more second end mounting screws 356 and mounting nuts 355 which are similar to the one or more first end mounting screws 256 and mounting nuts 255 for securing the first mounting bracket 250 to the housing 100. Specifically, as shown in FIG. 10, a locking tab 357 can extend in a direction oblique or perpendicular to the I-shaped beam at or near each end of the I-shaped beam. The number and locations of the locking tab 357 is not limiting, depending on the number and location of the T-slots 155 available on the elongate housing. Each locking tab 357 can have a clearance hole 353 similar to the clearance hole 253 of the first mounting bracket 250. To install the second mounting bracket 350, for example, before or after installing the light module 500, the second mounting bracket 350 can be placed across the width of the housing 100 so that the clearance hole(s) 353 can align with the one or more T-slots 155 of the housing 100. Two ends of the I-shaped beam can have extensions 354, which can be in contact with the inwardly extending ribs 157 defining the T-slots 155 and provide additional support to the second mounting bracket 350. As shown in FIG. 9, the second mounting bracket 350 can be place between two T-slots 155. The one or more second end mounting screws 356 can be inserted through the clearance holes 353 from the interior of the housing 100 into the T-slots 155 from the interior of the housing 100. The one or more second end mounting nuts 355 can each be slotted into one of the T-slots 155. The second end mounting screws 356 can then threadedly engage the second end mounting nuts 355, thereby fixedly clamping the second mounting bracket 350 to the housing 100. FIGS. 14B and 14D illustrate assembled views of the second mounting bracket 350 and the elongate housing 100 at or near the second end 120 using the plurality of second end mounting screws 356, and mounting nuts 355 slotted into the plurality of T-slots 155 of the elongate housing 100.

As shown in FIG. 10, the second mounting bracket 350 can have one or more locking screw holes 351 configured to allow one or more locking screws 160 to pass. FIG. 7 illustrates one or more corresponding locking screw holes 251 on the first mounting bracket 250. As shown in FIG. 3A, the one or more locking screws 160 can have the same or substantially the same length as the elongate housing 100. A length of the locking screw 150 can depend on the desired locations of the first and second mounting brackets 250, 350, and/or the height of the elongate housing 100. The locking screws 160 can be made available with a predetermined length that is substantially the same or longer than the length of the elongate housing 100 and can be cut to a desired length by the user by breaking off a terminal threaded portion of the locking screw 160. In some instances, passing the locking screw through the locking screw hole 351 and the threaded screw hole 251 can serve to keep the locking screw 160 straight as it is tightened against a pad 235.

Figure 11:
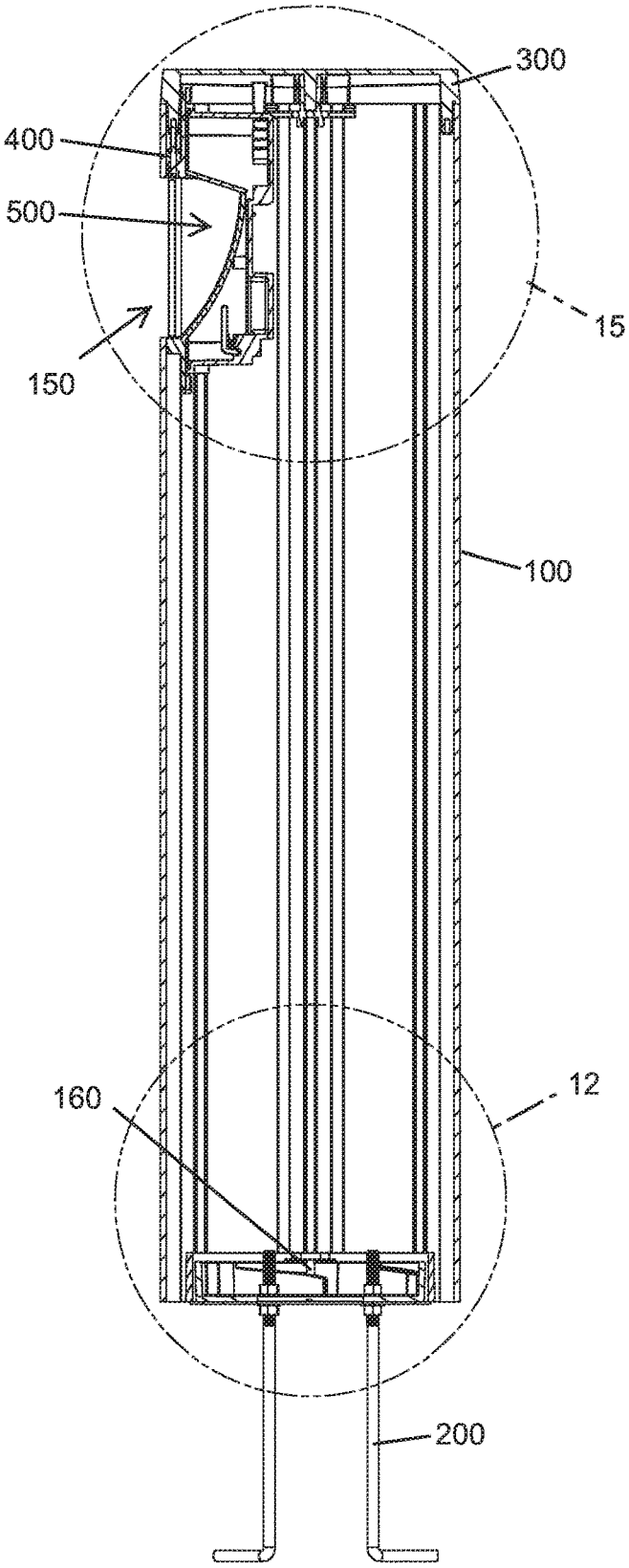
FIG. 11 illustrates a longitudinal cross-sectional view of the assembled lighting fixture of FIG. 2 when viewed from a side of the lighting fixture.
Figure 12:
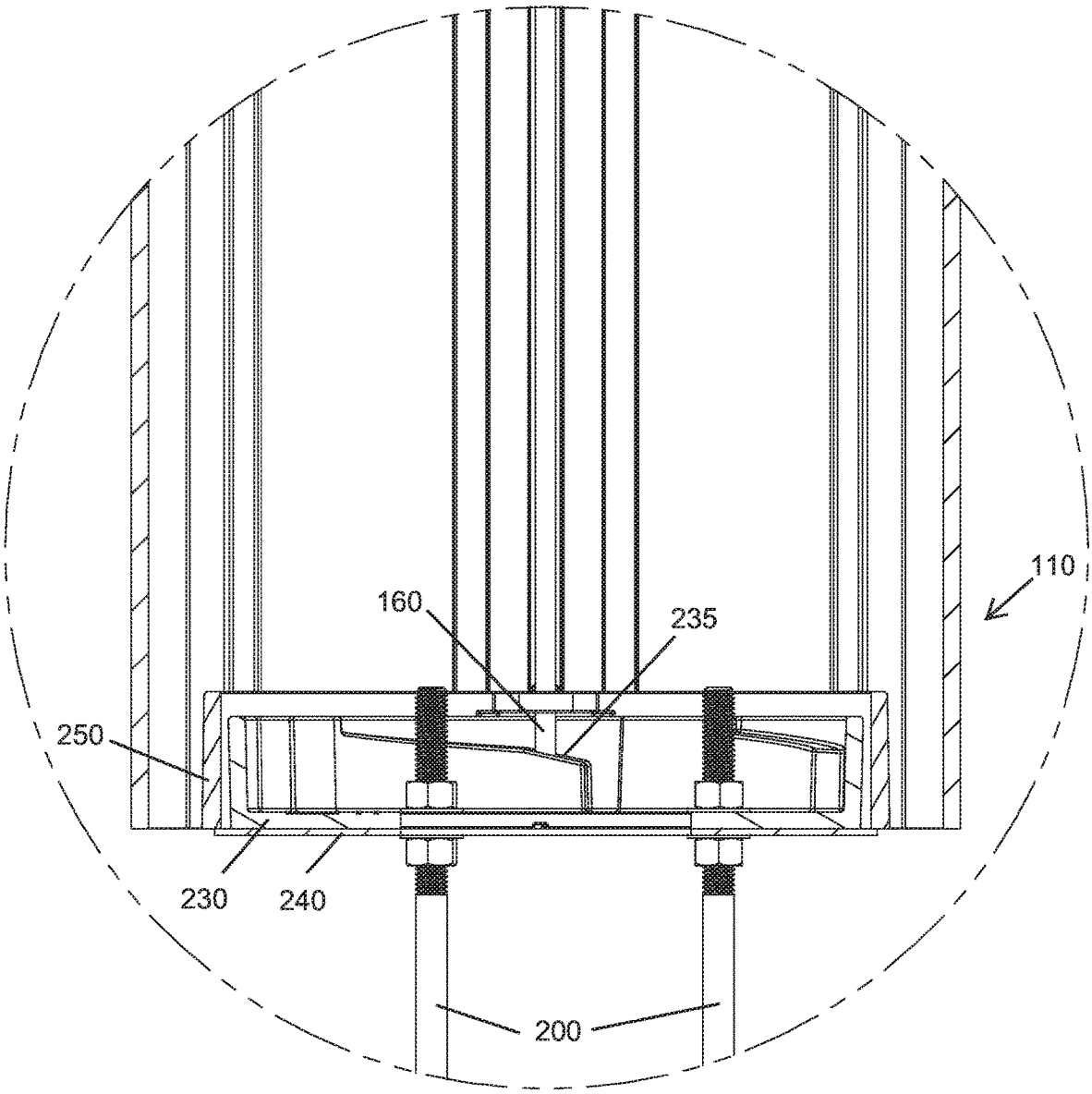
FIG. 12 illustrates a detailed longitudinal cross-sectional side view of an assembled first end of the lighting fixture of FIG. 11.

FIGS. 11-12 illustrate one of the locking screws 160 installed to lock the relative positions of the first mounting bracket 250 and the installation base 230. As more clearly shown in FIG. 12, after one of the locking screw 160 engages the locking screw holes 251, 351 of the first and second mounting brackets 250, 350 respectively, the locking screw 160 can be advanced until a terminal end of the locking screw 160 contacts a pad 235 (also shown in FIG. 5) on the installation base 230. Friction between the terminal end of the locking screw 160 and the pad 235 can augment the friction between the cam(s) 238 on the installation base 230 and the locking tab(s) 258 on the first mounting bracket 250, which can inhibit or prevent further rotation of the elongate housing 100 relative to the installation base 230 after a desired connection between the elongate housing 100/first mounting bracket 250 subassembly and the installation base 230 has been achieved. More specifically, interference between the locking screw(s) 160 and the pad(s) 235 (e.g., or other cam surface) can inhibit or prevent rotation of the mounting bracket 250 with respect to the installation base 230 in a first direction of rotation, while engagement between the locking tabs 258 and cams 238 inhibits or prevents rotation of the mounting bracket 250 with respect to the installation base 230 in a second direction or rotation, opposite the first direction or rotation.

As shown in FIG. 5, the pad 235 can include a slanted or sloped surface internal to the wall 236 of the installation base 230, with the slope decreasing in the clockwise direction. The slope orientation can inhibit or prevent free or easy counterclockwise rotation of the elongate housing 100/first mounting bracket 250 subassembly relative to the installation base 230, which can loosen the elongate housing 100/first mounting bracket 250 subassembly from the installation base 230. In some instances the slope of the pad 235 insures the first mounting bracket 250 is fully rotationally engaged with the installation base 230. The installation base 230 can have one pad 235 for each locking screw 160. Alternatively, the cams 238 can prevent further rotation in a counterclockwise manner, and the pad can have a slope decreasing in the counterclockwise direction to make it difficult to rotate the elongate housing/first mounting bracket in the clockwise direction to loosen the elongate housing from the installation base.

At this point of the installation of the lighting fixture 10, all the fastening tools, such as screws and nuts, are position in the interior of the elongate housing 100. As described above, keeping as many of the fastening features as possible in the interior of the elongate housing 100 can create an aesthetically more pleasing outer appearance of the lighting fixture 10. Access to these fastening features from the first end 110 of the housing is blocked off by the surface of the concrete slab or foundation. The cover 300 can then be placed over the second end 120 of the housing to block access to the interior of the housing from the second end 120. In some applications, the housing 100 and cover 300 can at least partially shield the fastening features inside the housing 100 from external environments, which can cause or speed up rust or crack formation on the fastening features.

Figure 13:
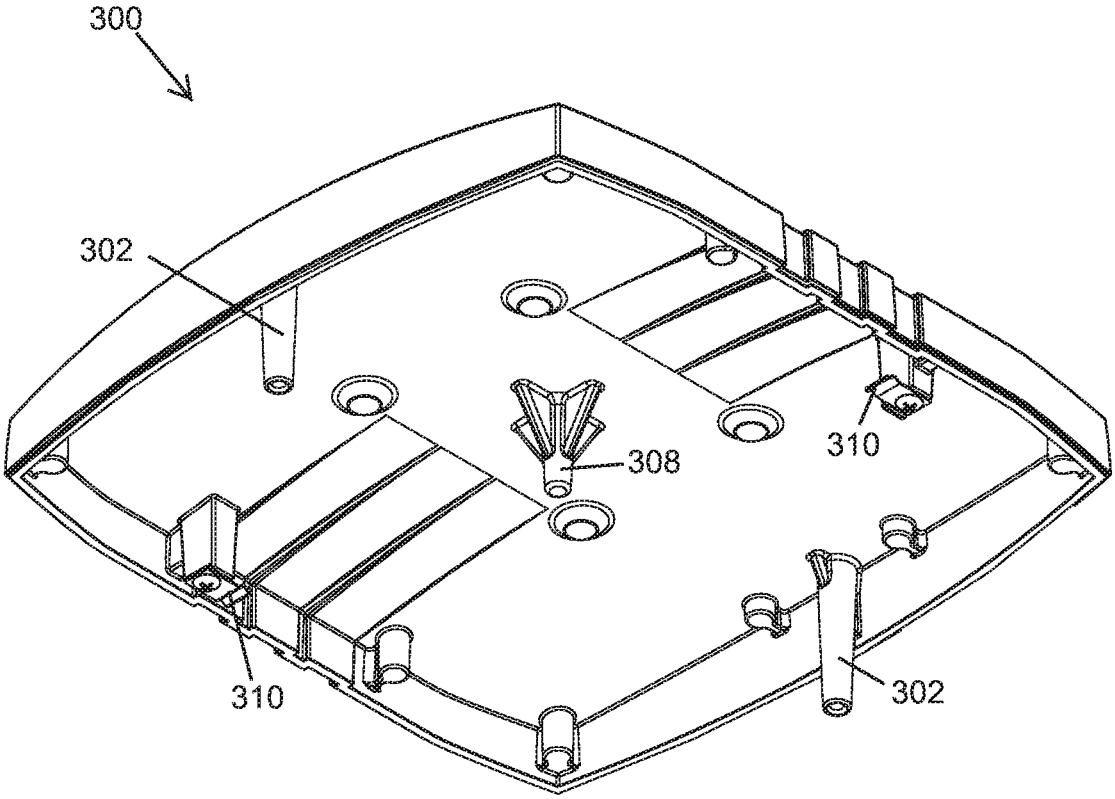
FIG. 13 illustrates a bottom perspective view of a cover of the lighting fixture.

As shown in FIG. 13, the cover 300 can be shaped and sized to match the transverse cross-section of the elongate housing 100. For example, the cover 300 can have a generally rectangular or square shape. Depending on the cross-sectional shape and size of the elongate housing 100, the shape and size of the cover 300 can vary accordingly. In some embodiments, the cover 300 has a shape different from that of the elongate housing 100. The cover 300 can have a generally smooth outer surface. The outer surface of the cover 300 can optionally have decorative features that match or are complementary to the decorative features on the outer wall of the housing 300. When installed, the decorative features on the housing 100 and the cover 300 can appear to be contiguous to provide a more aesthetically pleasing outer appearance. The decorative features, such as one or more channels, ribs, indentations, protrusions, and/or other features can also provide indication of orientations of the functional features on an under side of the cover to allow easier installation by the user.

Figure 14A:
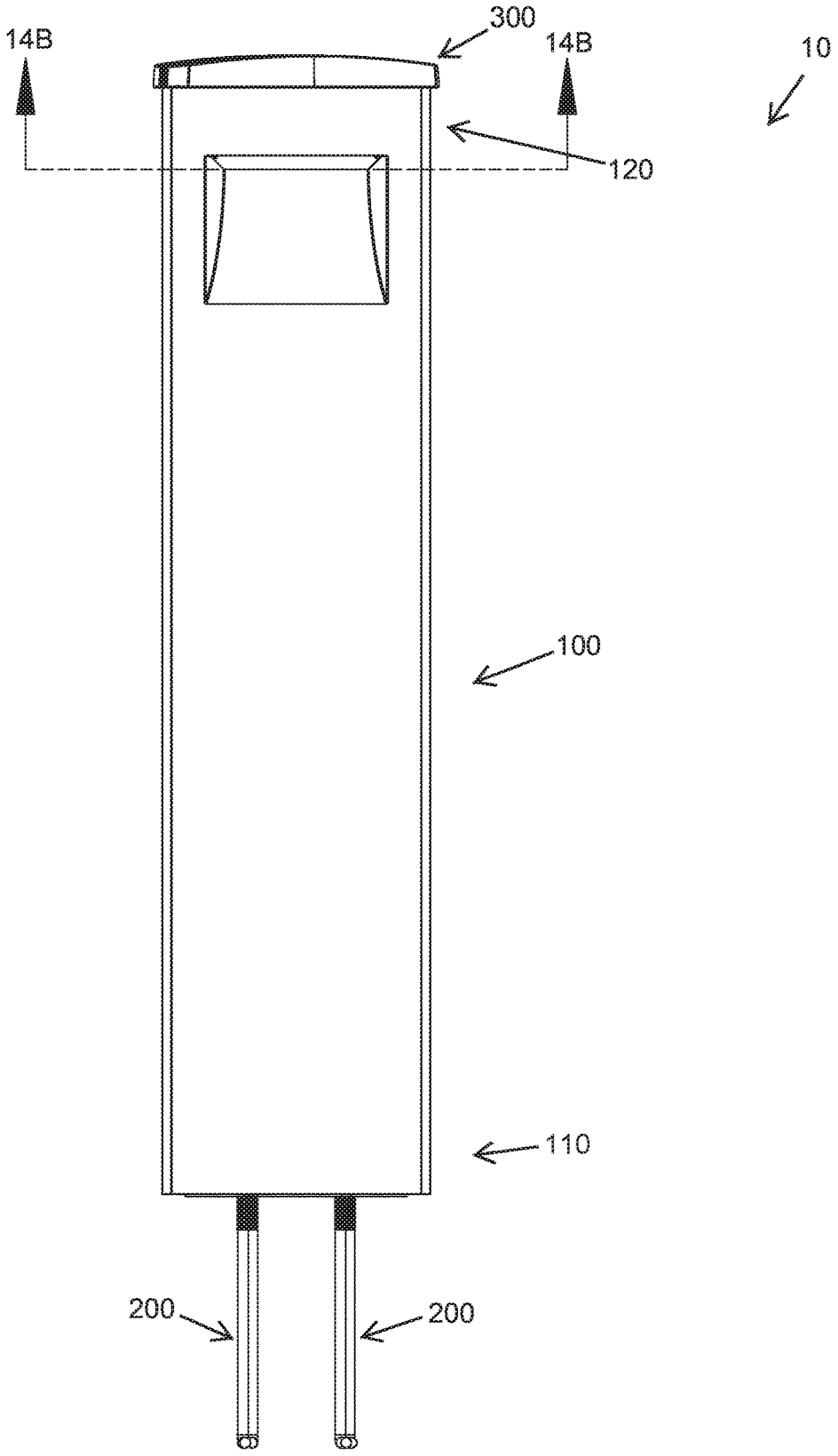
FIG. 14A illustrates a front view of a lighting fixture with a partially assembled cover.
Figure 14B:
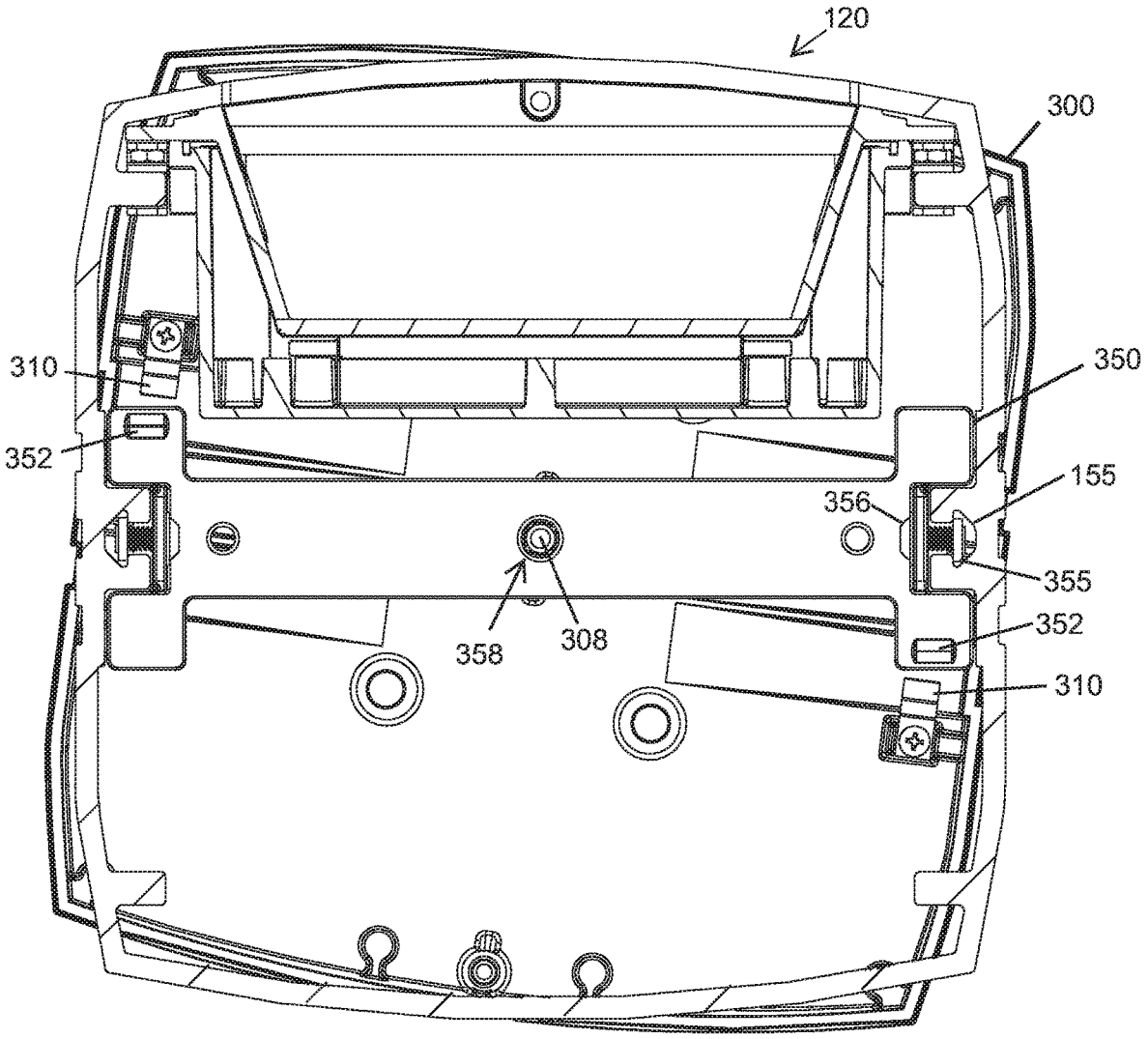
FIG. 14B illustrates a transverse cross-sectional view of the lighting fixture of FIG. 14A viewed from an upper end of a window toward the cover. The locking screw(s) are omitted for clarity.
Figure 14C:
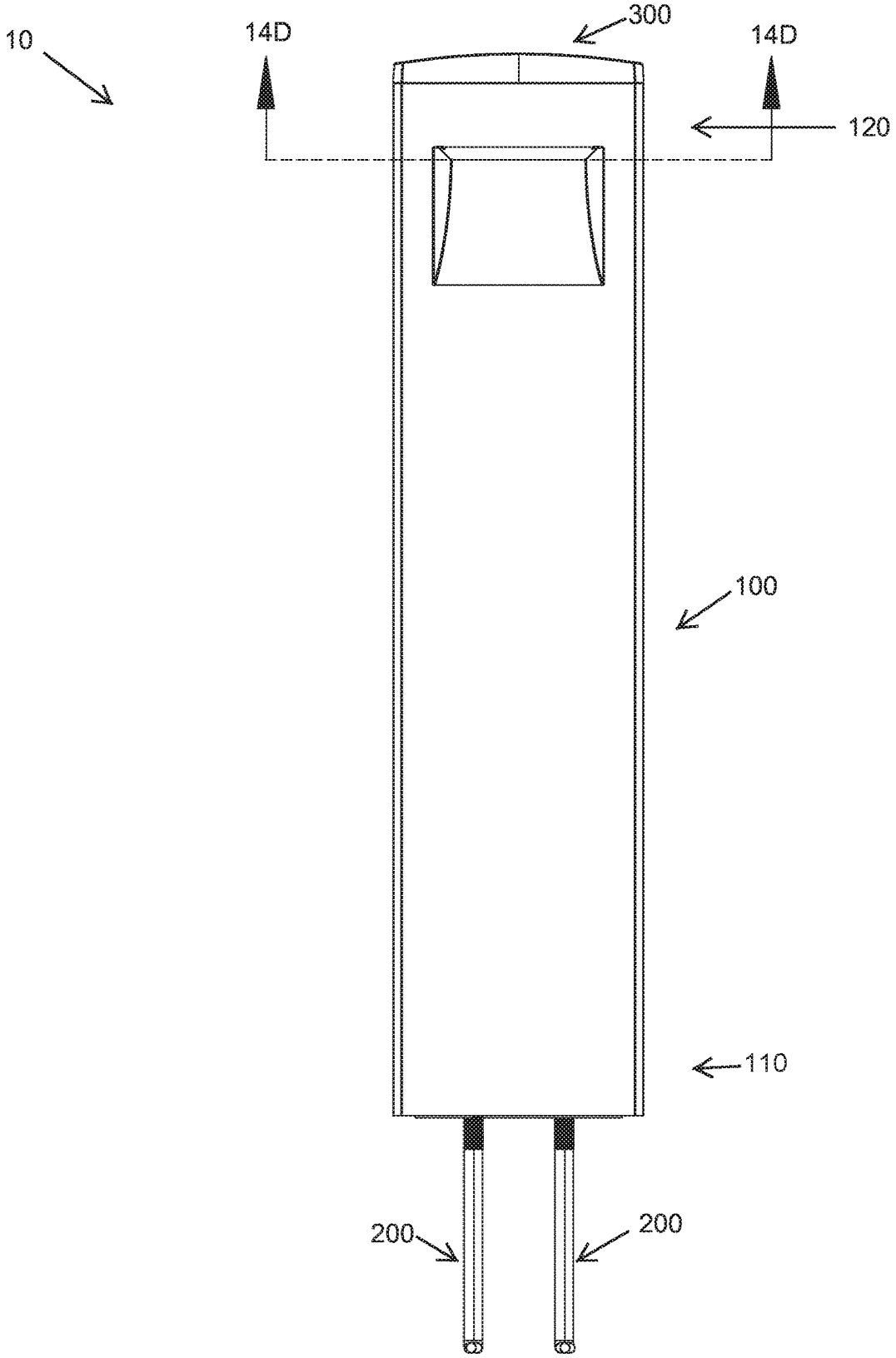
FIG. 14C illustrates a front view of a lighting fixture with a fully assembled cover.
Figure 14D:
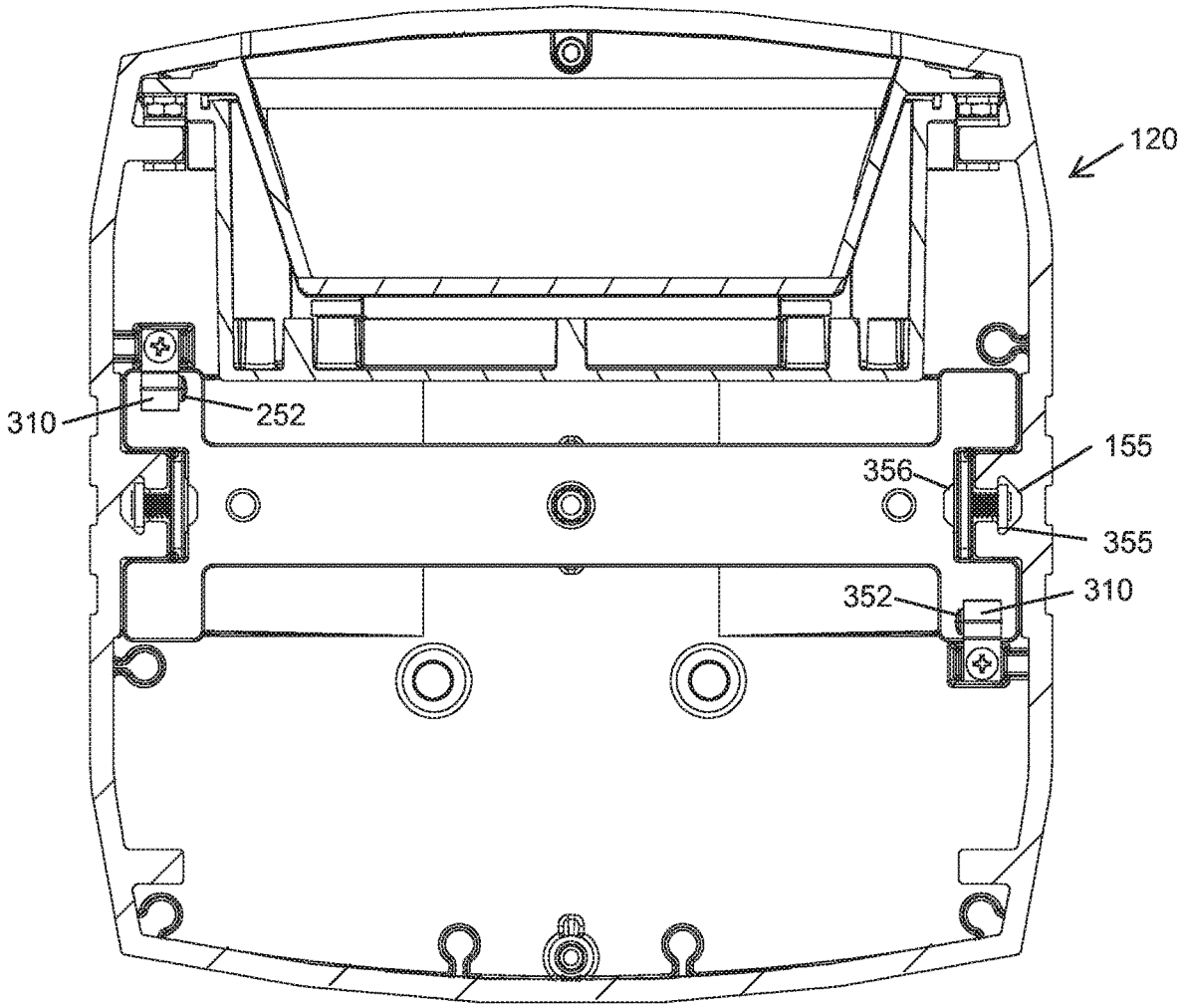
FIG. 14D illustrates a transverse cross-sectional view of the lighting fixture of FIG. 14C viewed from an upper end of a window toward the cover. The locking screw(s) are omitted for clarity.

FIGS. 14A-14D illustrate how the cover 300 can be assembled onto the lighting fixture 10. FIG. 14A illustrates a partially assembly lighting fixture 10 with the cover 300 placed onto the second end 120 of the housing at an angle such that the sides of the cover 300 do not align with, but are offset from the sides of the elongate housing 100. The under or internally-facing side of the cover 300 can have one or more retainer clips 310. The one or more retainer clips 310 can be integral to the cover 300, or coupled to the underside of the cover 300 using fasteners, adhesive, or the like. As shown in the cross-sectional view of FIG. 14B, looking up from under the second mounting bracket 350 toward the cover 300, the cover 300 can be placed slightly tilted onto the elongate housing 100 such that the one or more retainer clips 310 can be adjacent to one or more mating features on the second mounting bracket 350 or on some other portion of the housing 100. For example, the second mounting bracket 350 can include one or more indents 352, protrusions, or other mating features (e.g., on the extensions 354 of the second mounting bracket 350). At least one indent 352 can be on one side of each of the extensions 354. When there are two retainer clips 310 on the underside of the cover 300, the two retainer clips 310 can be positioned diagonal to each other across the I-shaped beam of second mounting bracket 350. FIGS. 14C-14D illustrate the cover 300 after rotating the cover 300 as shown in FIGS. 14A-14B in a counterclockwise fashion so that the sides of the cover 300 align with the sides of the elongate housing 100. The rotation substantially simultaneously pushes the one or more retainer clips 310 into engagement with the one or more indents 352 on the second mounting bracket 350. In some embodiments, the retainer clips 310 can be positioned as a mirror image of the retainer clips 310 shown in FIGS. 14B and 14D such that the cover 300 is rotated in a clockwise fashion to engage the retainer clips 310 and the indents 352.

The one or more retainer clips 310 can be cantilevers, which can deflect momentarily when the retainer clips come into contact with the extensions 354 of the second mounting bracket 350, and return to their initial positions when the retainer clips 310 reach the indents 352. The retainer clips 310, such as the cantilevers, can be configured such that the user can overcome, with a nondestructive force, the resistance due to the engagement of the retainer clips 310 and the indents 352 to remove the cover 300 after the cover 300 has been clipped into place on the elongate housing 100. Alternatively, the retainer clips 310 can each have a stopper, for example but not limited to a hook or a barb, to permit only a one-way rotation of the cover 300 relative to the housing 100 such that the user cannot remove the cover 300 once it is placed into place without a destructive force. Features for coupling the cover 300 to the elongate housing 100 are not limiting. For example, the cover 300 can slide linearly onto the elongate housing, or be fixedly attached to the elongate housing 100 by adhesives.

Figure 15:
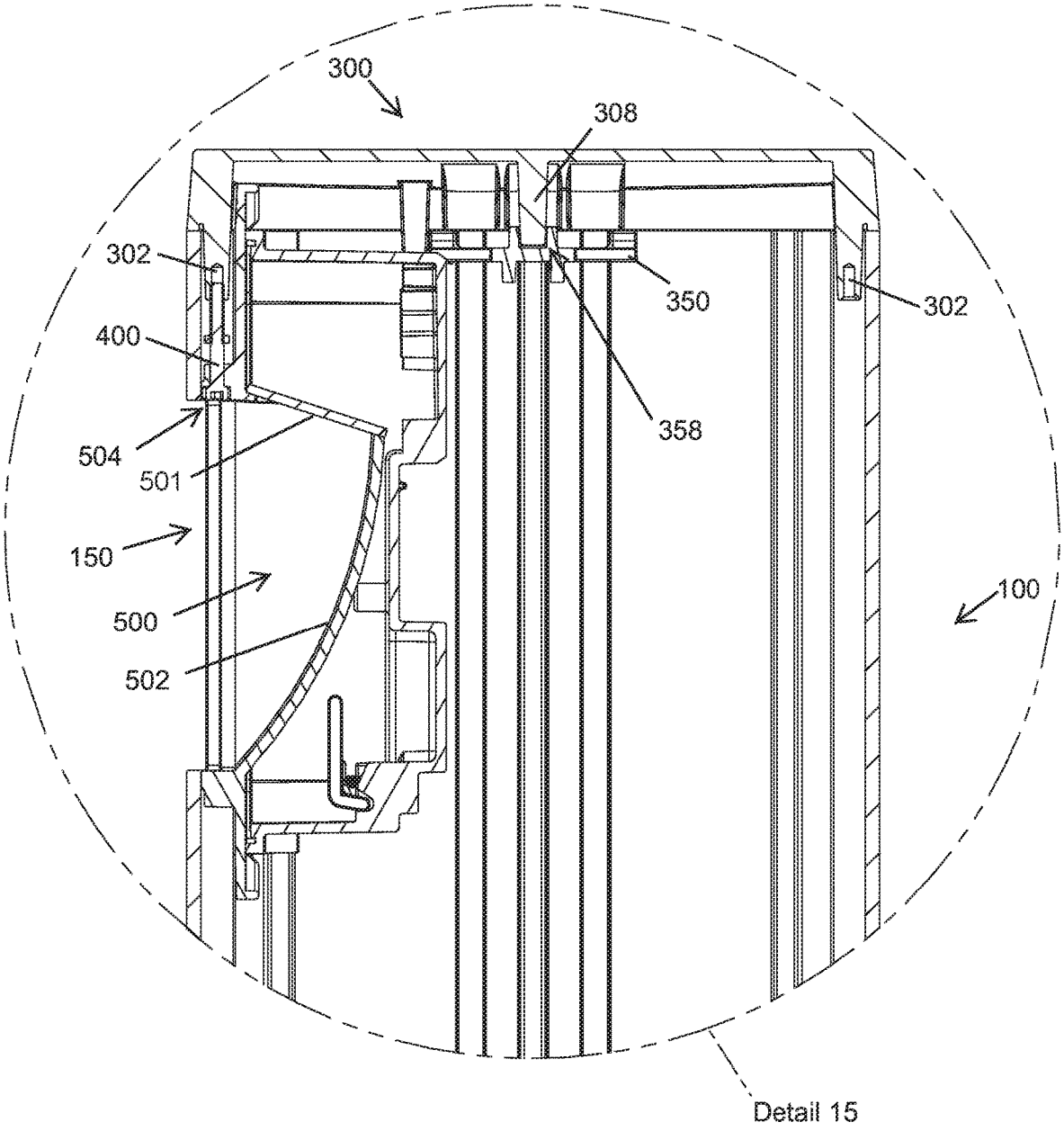
FIG. 15 illustrates a detailed view of an assembled second end of the light fixture of FIG. 11.
Figure 16:
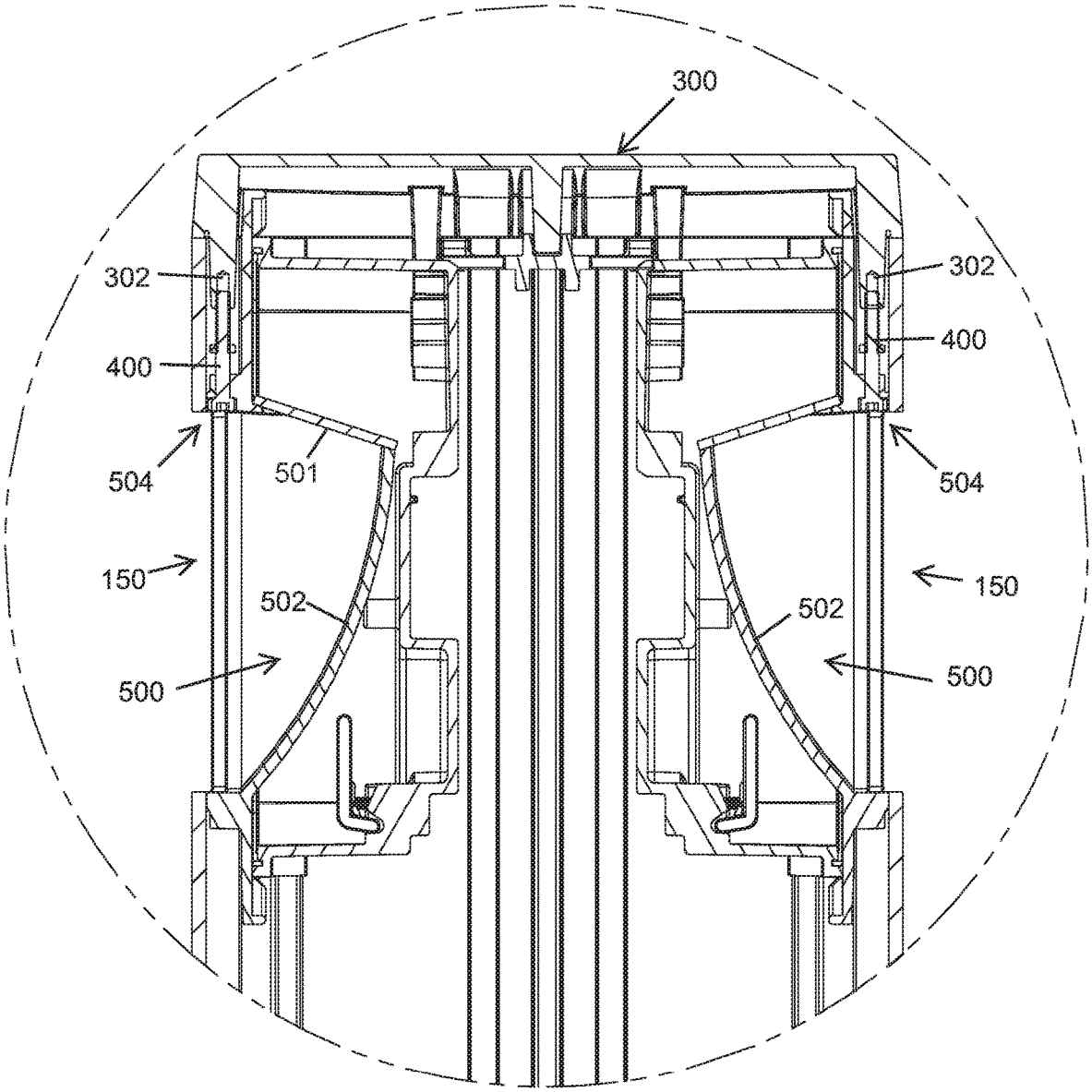
FIG. 16 illustrates a detailed view of an assembled second end of another example light fixture.
Figure 17:
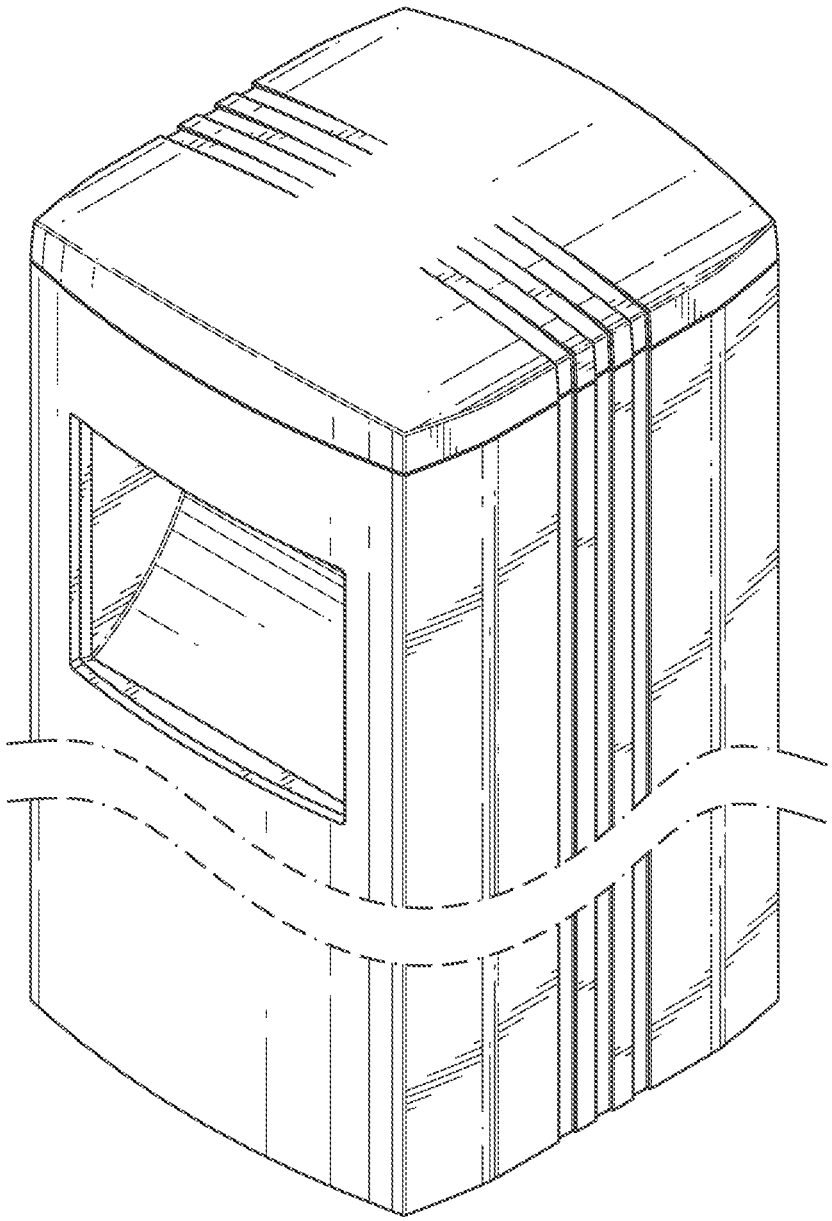
FIG. 17 illustrates a top, front, and right side perspective view of a lighting fixture embodying a new design.
Figure 18:
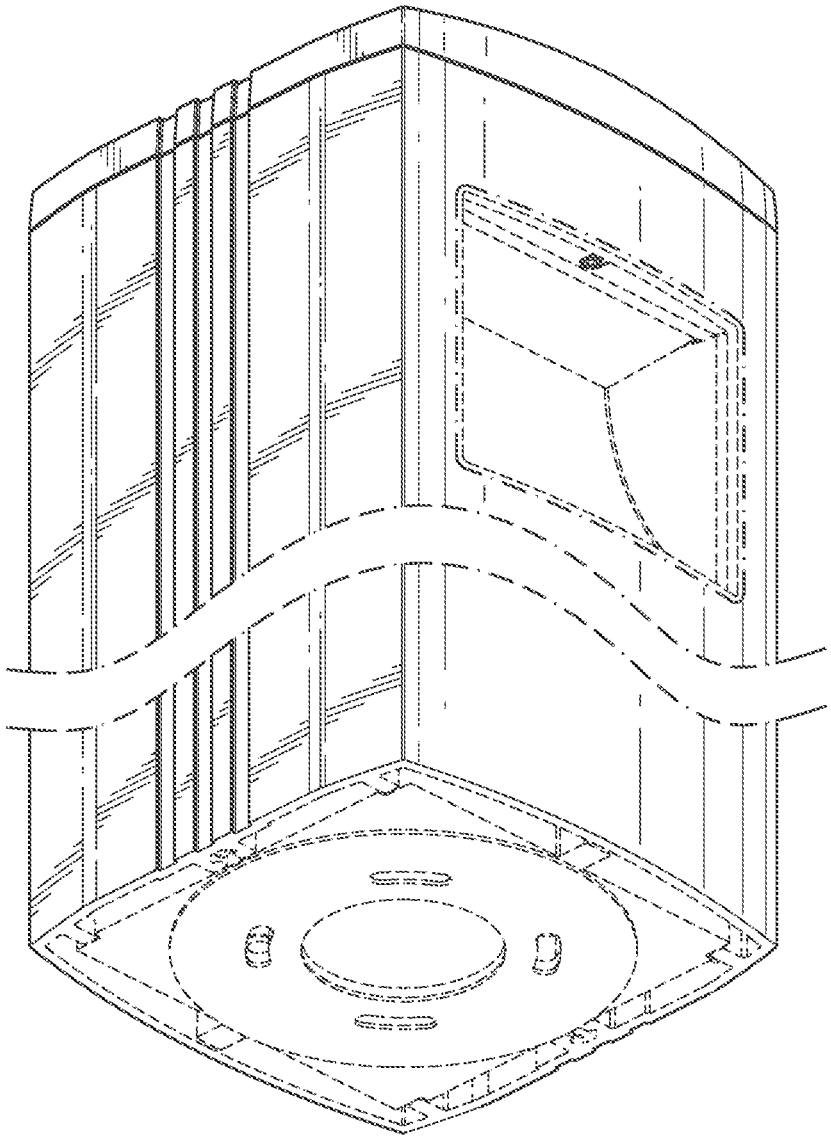
FIG. 18 illustrates a bottom, back, and right side perspective view of the lighting fixture of FIG. 17.
Figure 19:
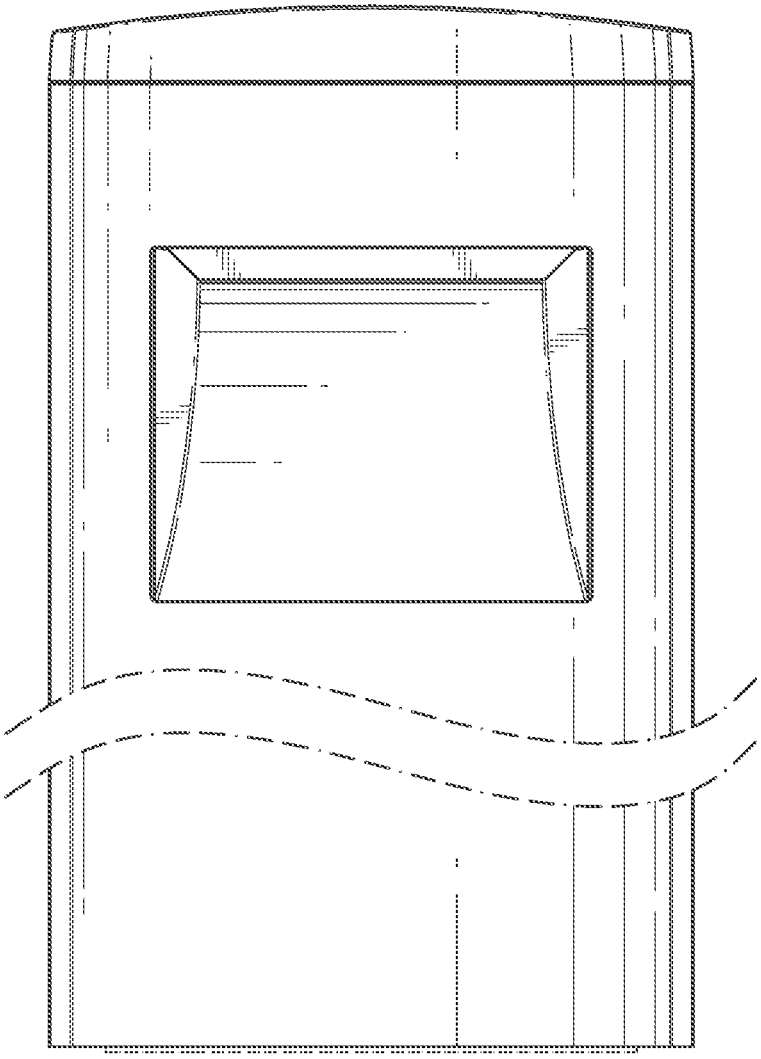
FIG. 19 illustrates a front view of the lighting fixture of FIG. 17.
Figure 20:
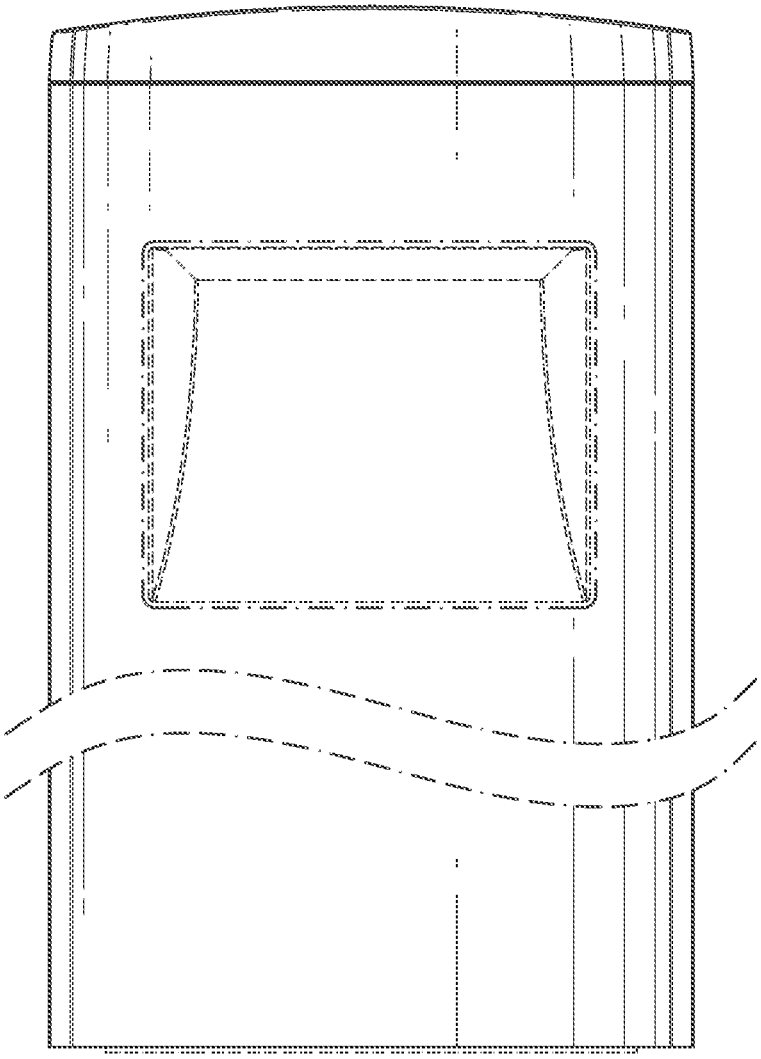
FIG. 20 illustrates a back view of the lighting fixture of FIG. 17.
Figure 21:
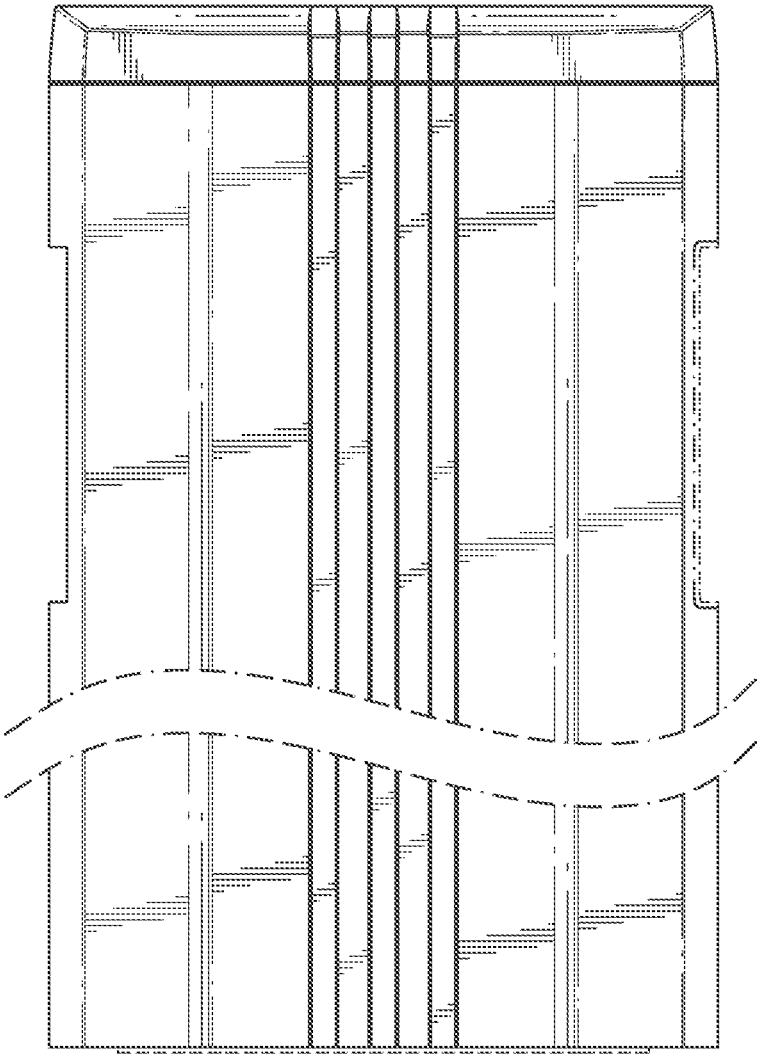
FIG. 21 illustrates a right side view of the lighting fixture of FIG. 17.
Figure 22:
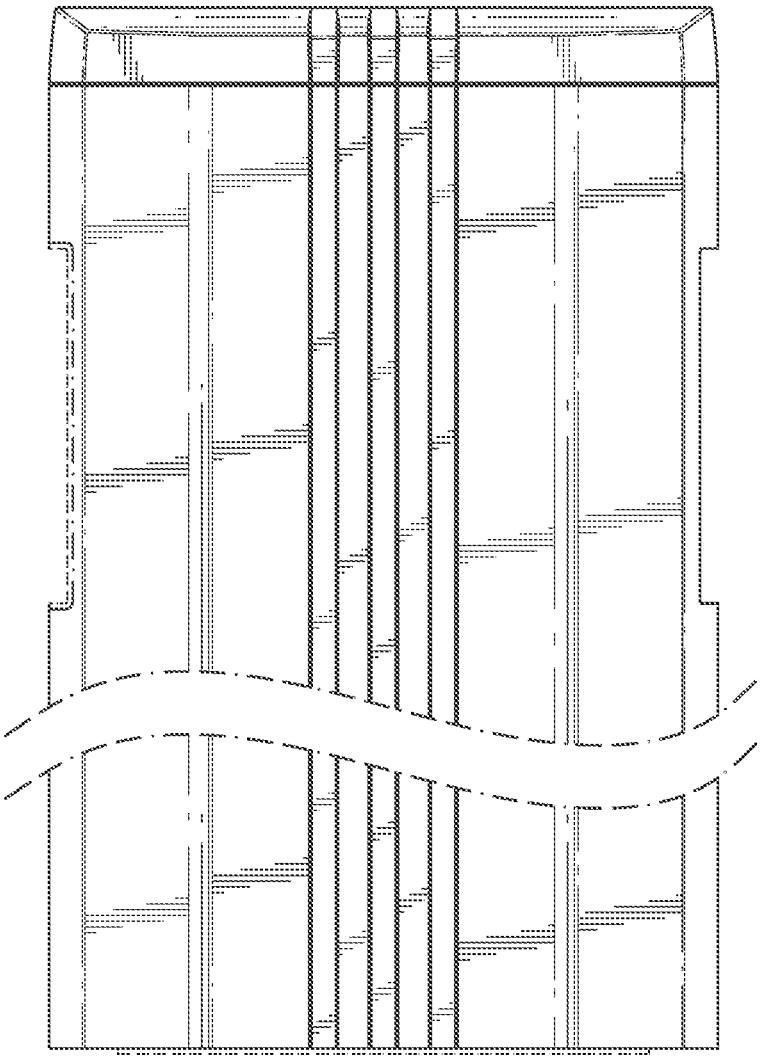
FIG. 22 illustrates a left side view of the lighting fixture of FIG. 17.
Figure 23:
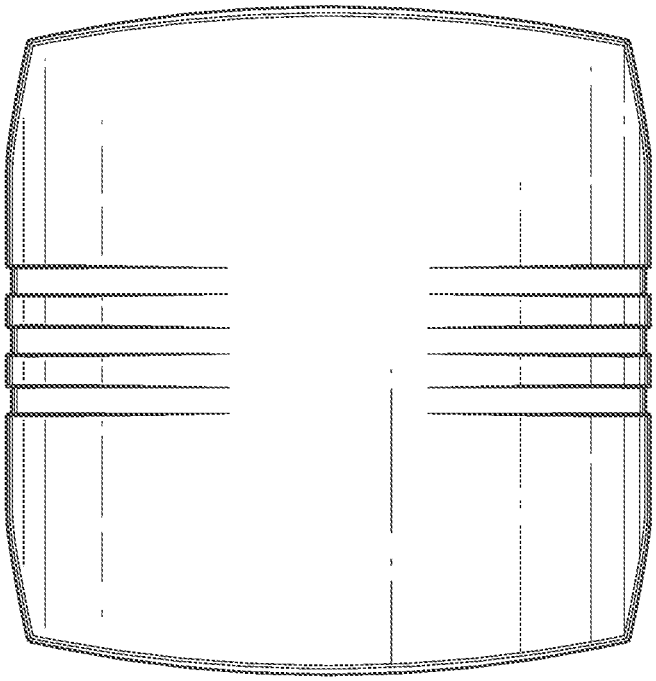
FIG. 23 illustrates a top view of the lighting fixture of FIG. 17
Figure 24:
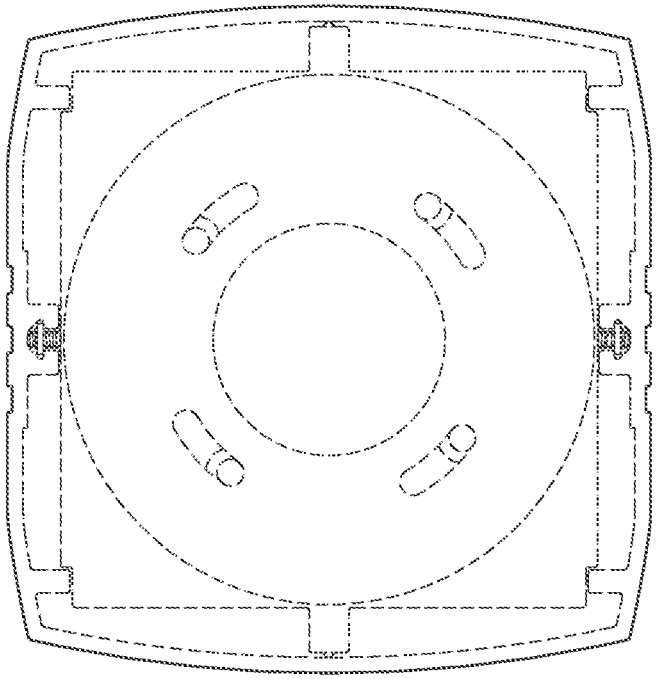
FIG. 24 illustrates a bottom view of the lighting fixture of FIG. 17.
Figure 25:
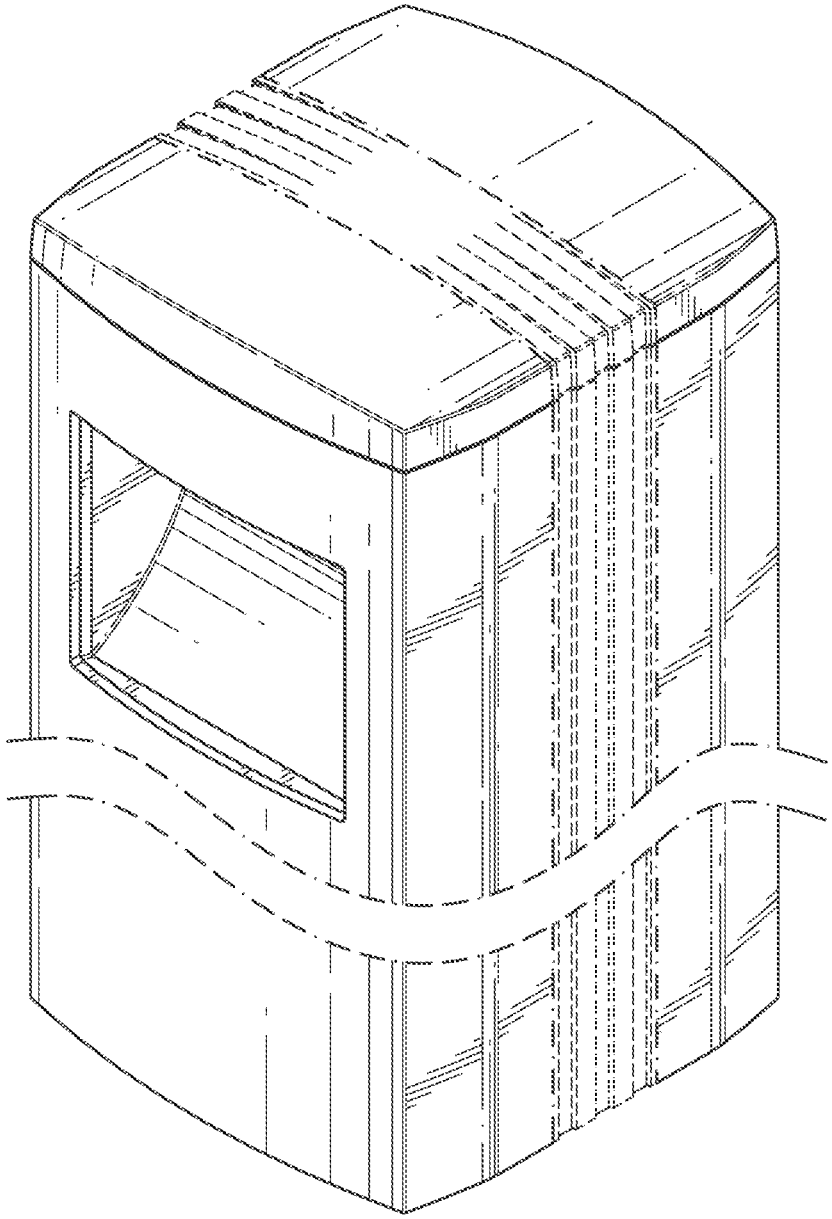
FIG. 25 illustrates a top, front, and right side perspective view of a lighting fixture embodying a new design.
Figure 26:
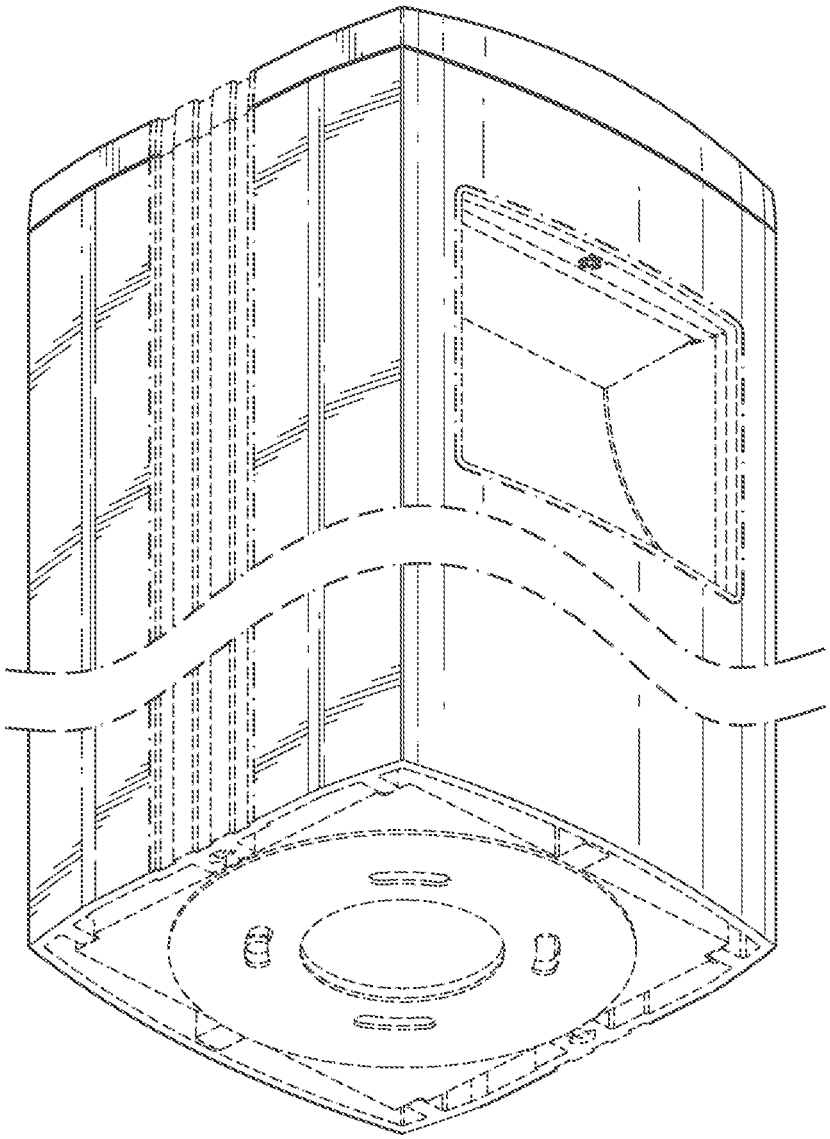
FIG. 26 illustrates a bottom, back, and right side perspective view of the lighting fixture of FIG. 25.
Figure 27:
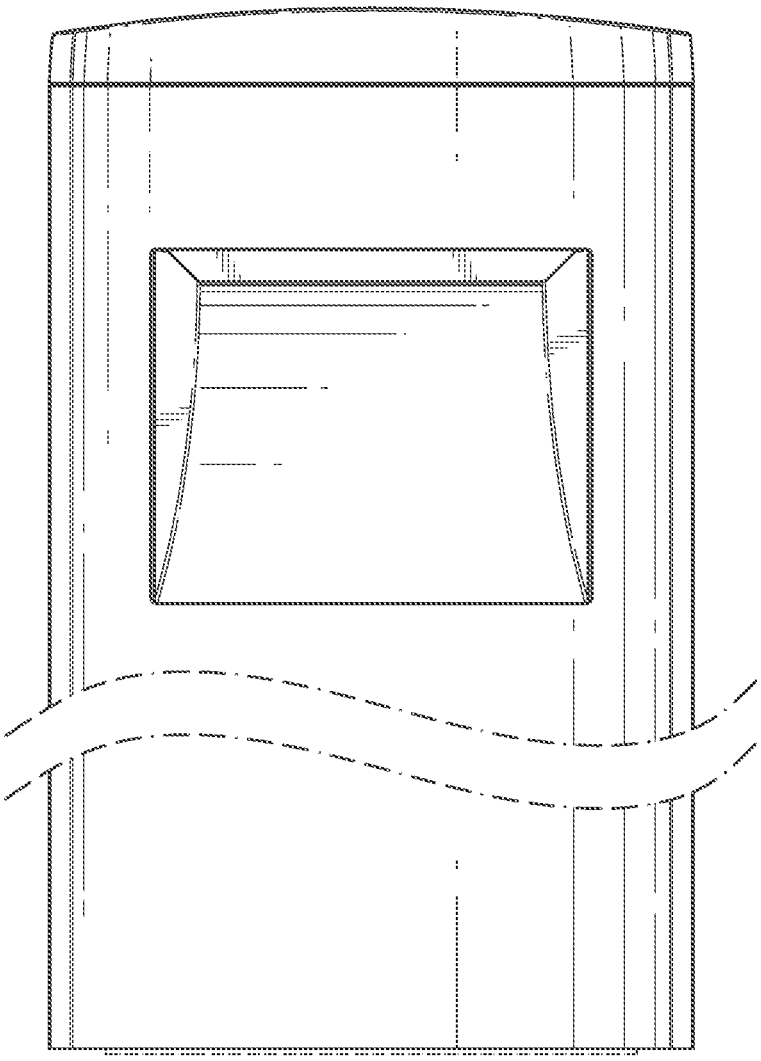
FIG. 27 illustrates a front view of the lighting fixture of FIG. 25.
Figure 28:
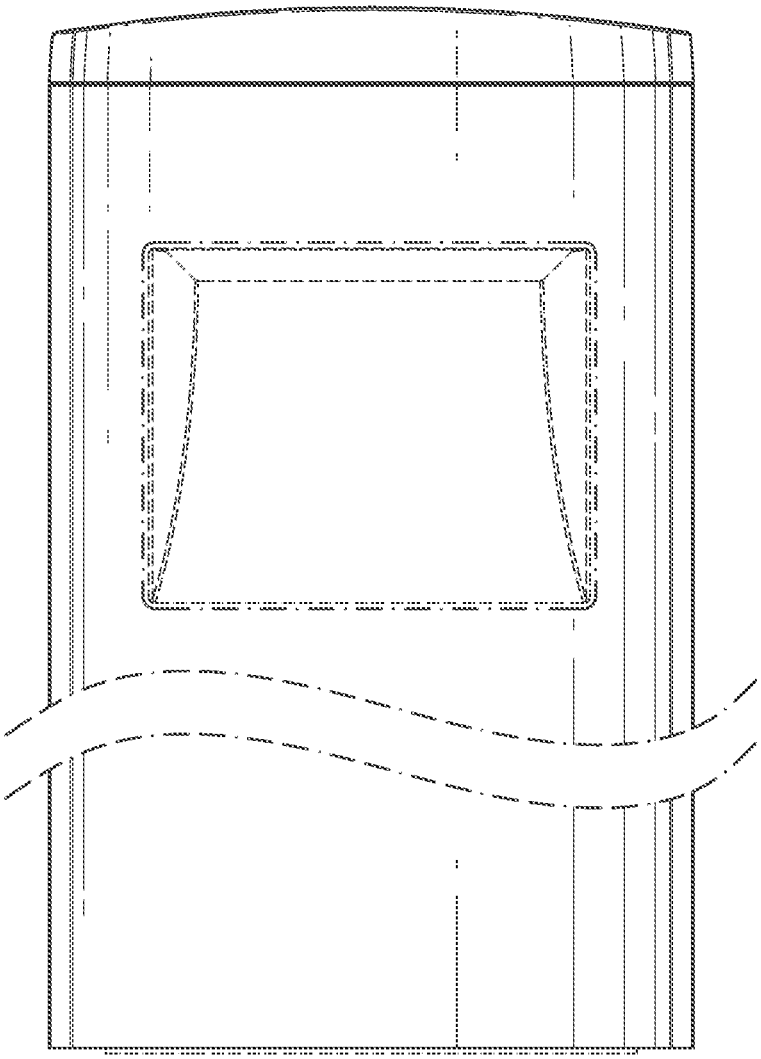
FIG. 28 illustrates a back view of the lighting fixture of FIG. 25.
Figure 29:
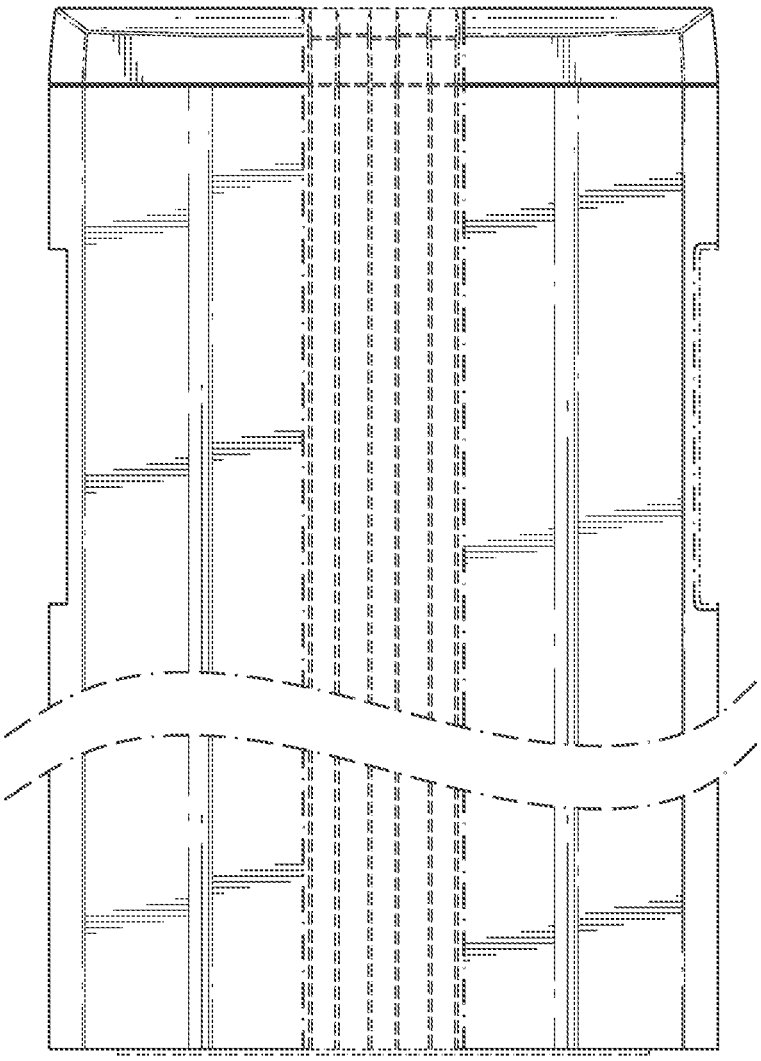
FIG. 29 illustrates a right side view of the lighting fixture of FIG. 25.
Figure 30:
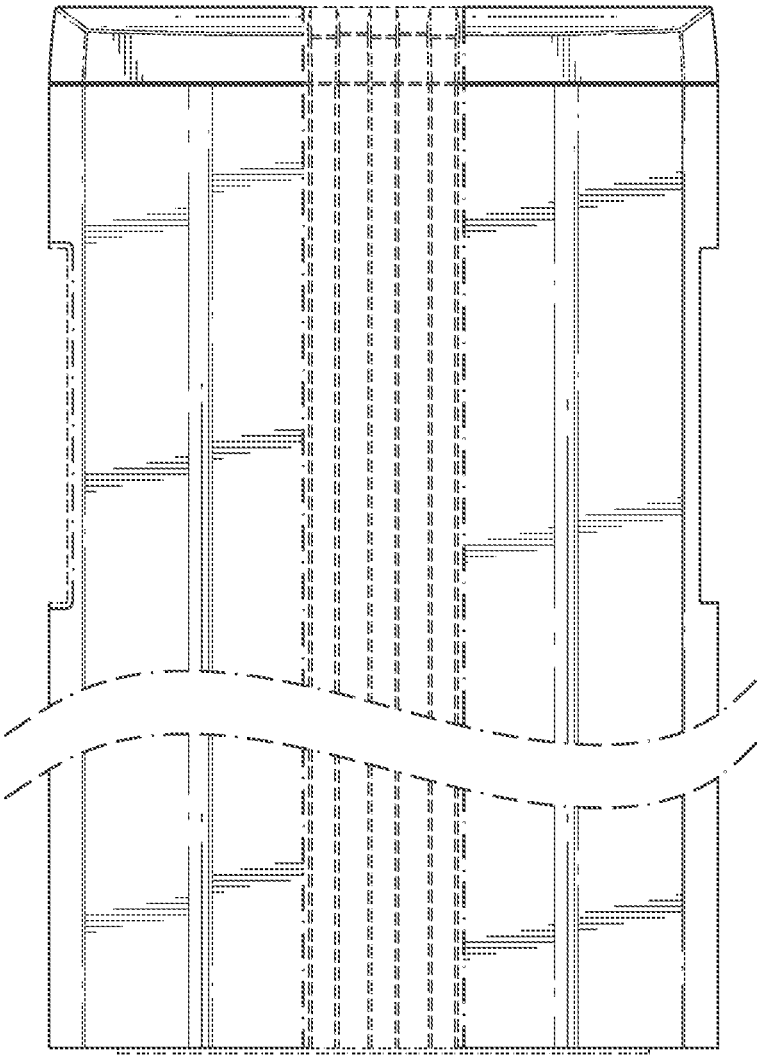
FIG. 30 illustrates a left side view of the lighting fixture of FIG. 25.
Figure 31:
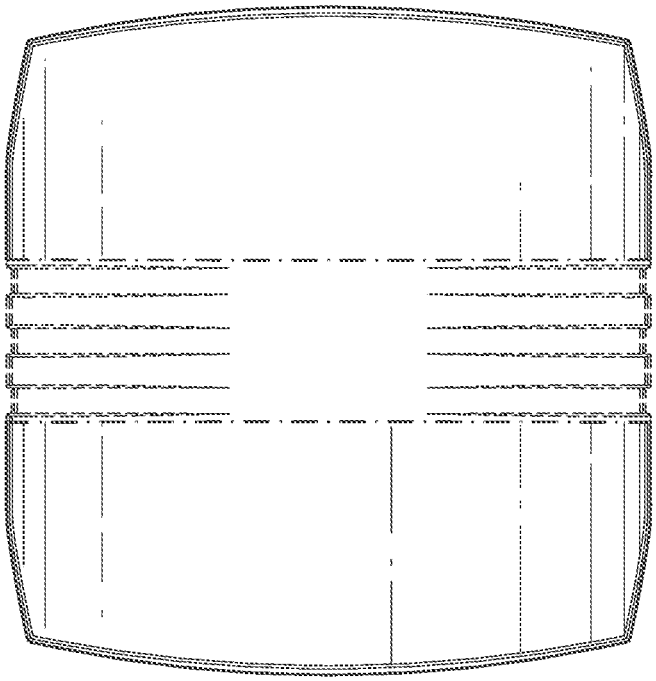
FIG. 31 illustrates a top view of the lighting fixture of FIG. 25.
Figure 32:
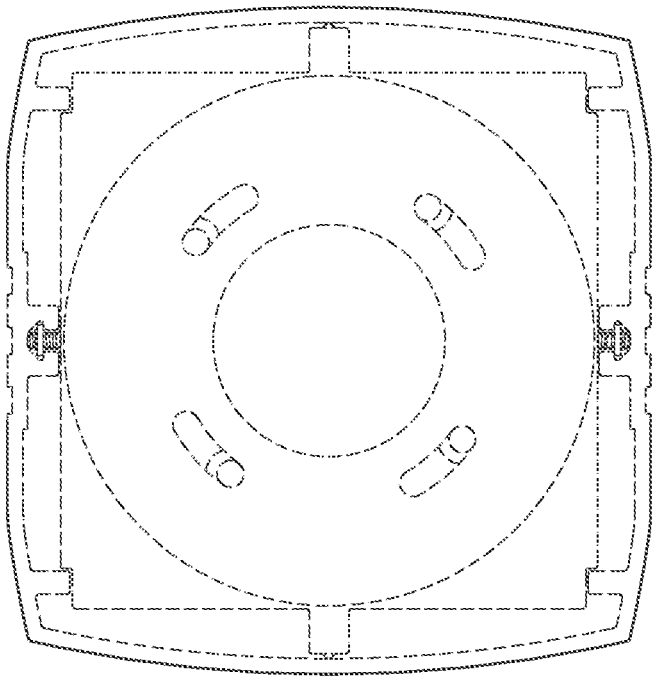
FIG. 32 illustrates a bottom view of the lighting fixture of FIG. 25.
Figure 33:
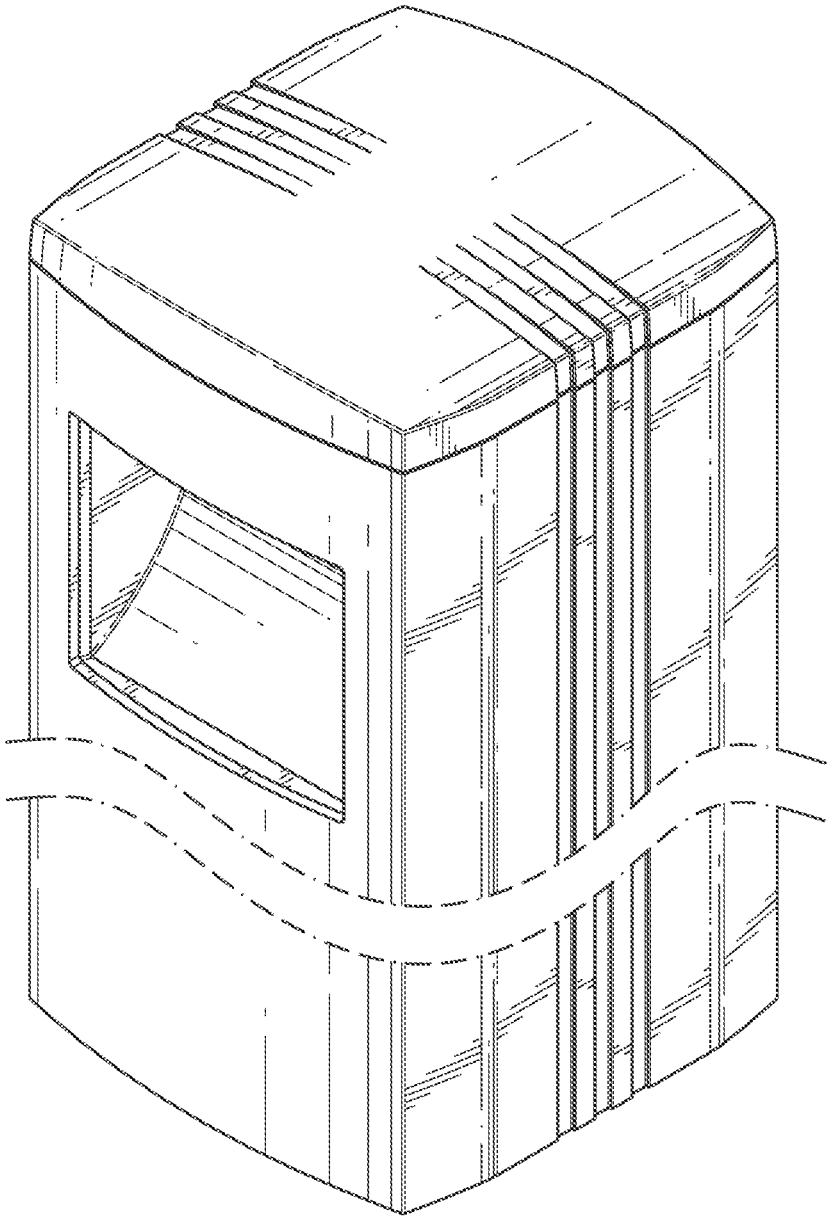
FIG. 33 illustrates a top, front, and right side perspective view of a lighting fixture embodying a new design.
Figure 34:
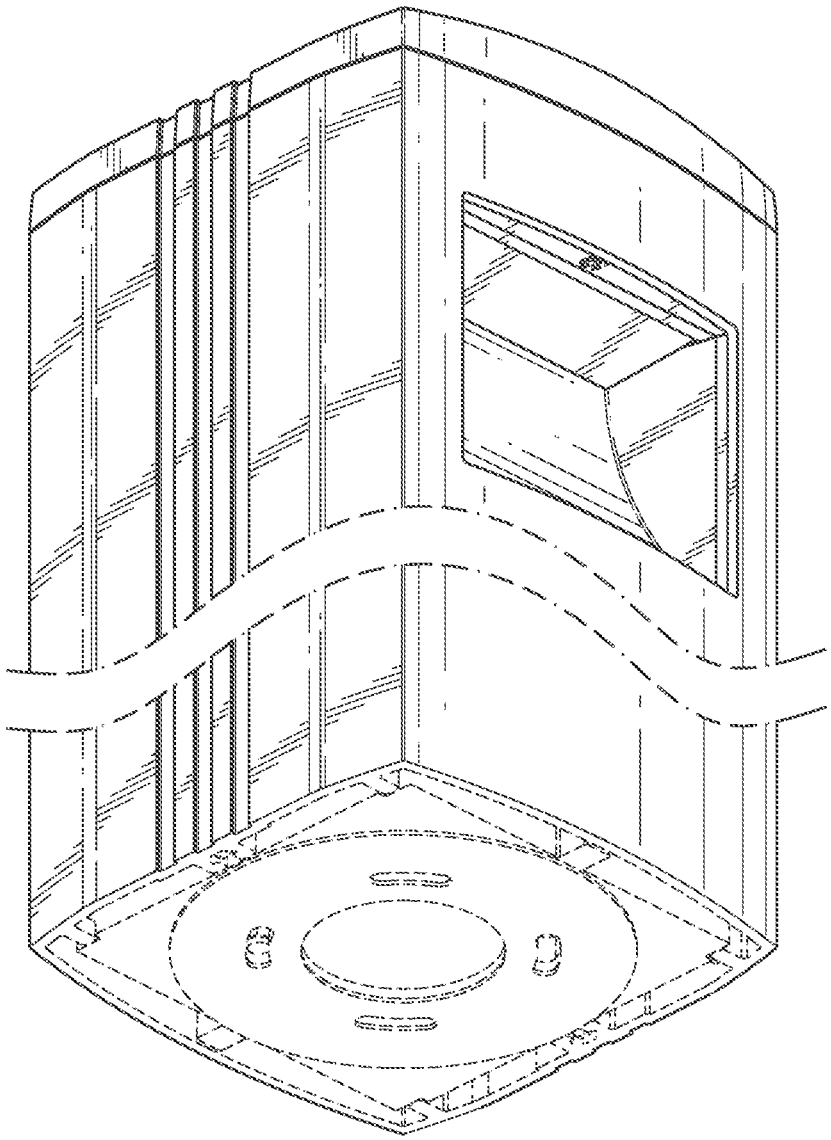
FIG. 34 illustrates a bottom, back, and right side perspective view of the lighting fixture of FIG. 33.
Figure 35:
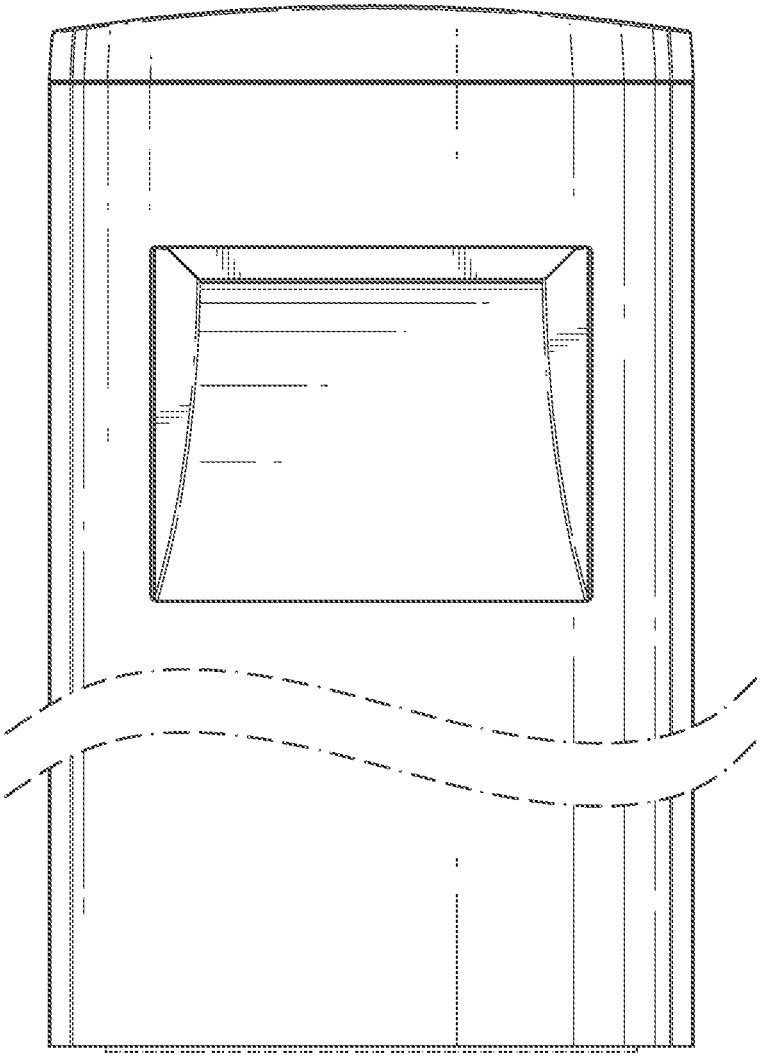
FIG. 35 illustrates a front view of the lighting fixture of FIG. 33.
Figure 36:
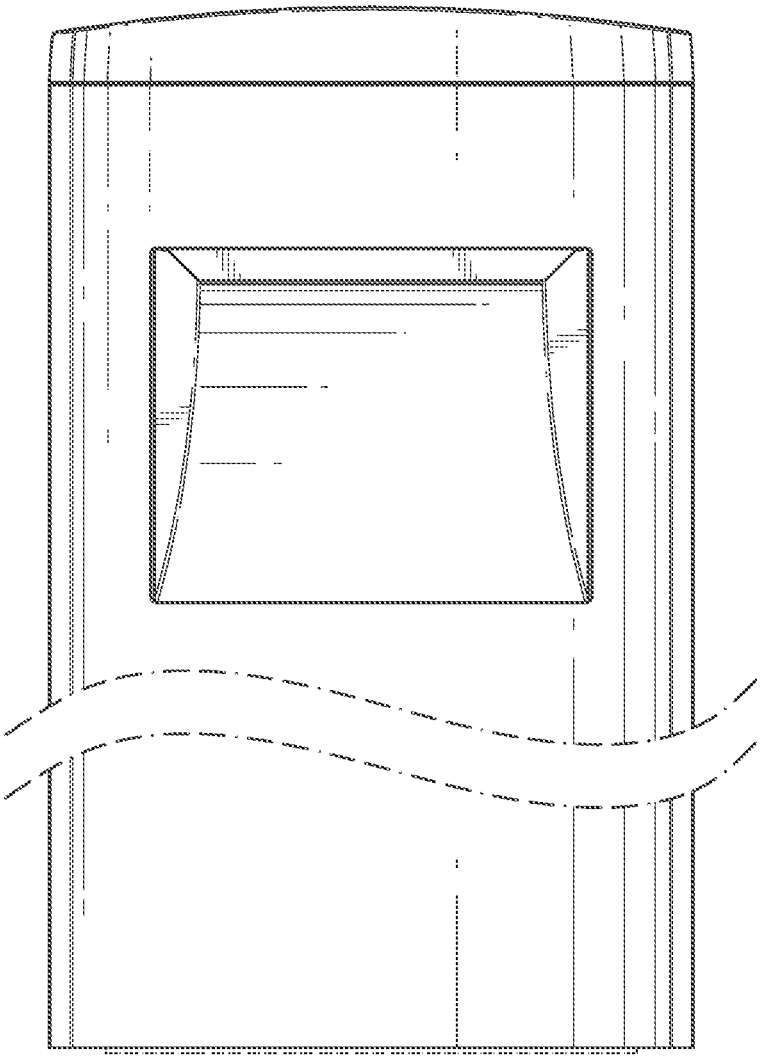
FIG. 36 illustrates a back view of the lighting fixture of FIG. 33.
Figure 37:
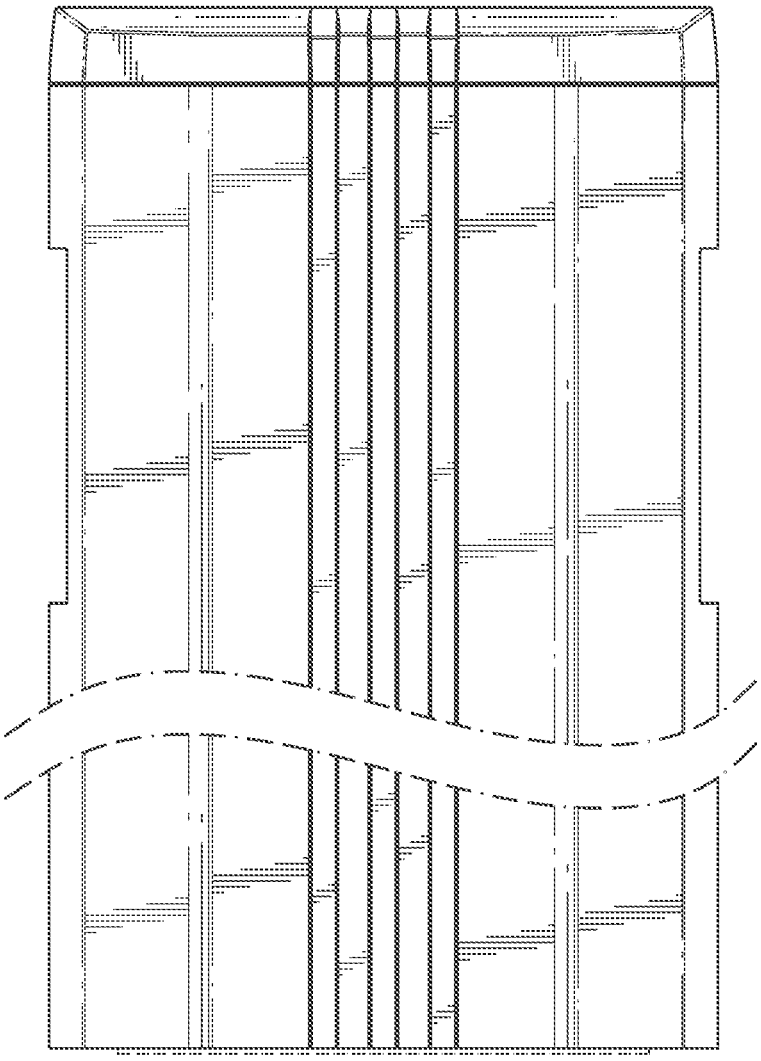
FIG. 37 illustrates a right side view of the lighting fixture of FIG. 33.
Figure 38:
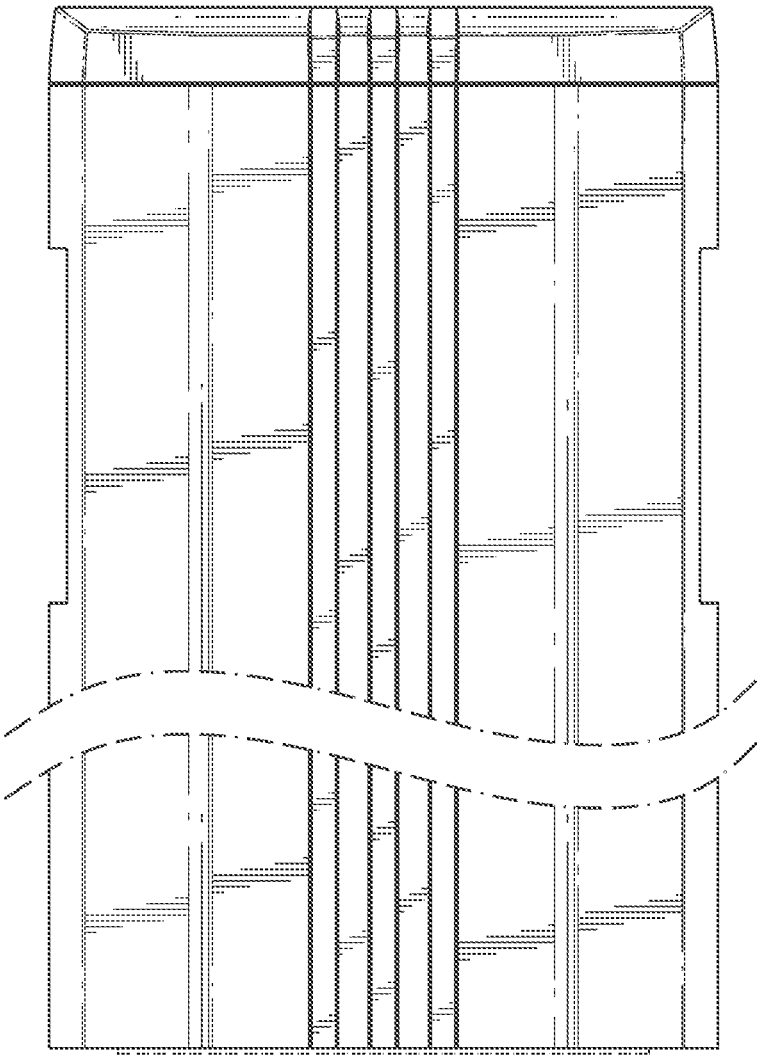
FIG. 38 illustrates a left side view of the lighting fixture of FIG. 33.
Figure 39:
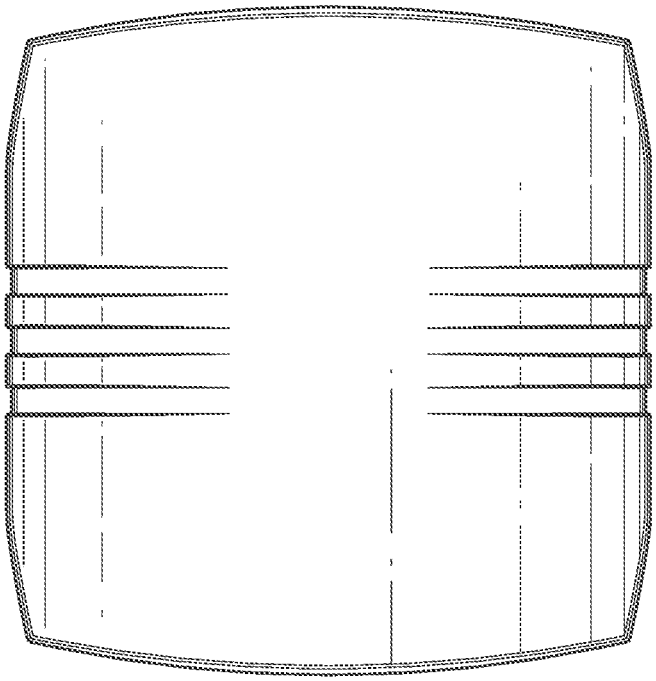
FIG. 39 illustrates a top view of the lighting fixture of FIG. 33.
Figure 40:
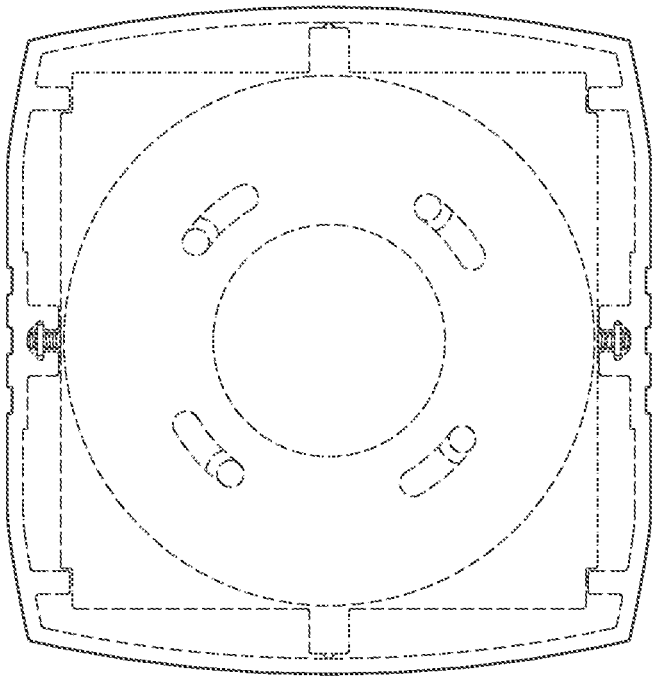
FIG. 40 illustrates a bottom view of the lighting fixture of FIG. 33.

Returning to FIG. 13, the underside of the cover 300 can include one or more screw posts 302. Each screw post 302 can have a threaded hole of a predetermined depth along a length of the screw post 302. As shown in FIGS. 15 and 16, after the cover 300 is clipped into place on the elongate housing 100, one or more cover screws 400 can be used to further secure the cover 300 to the elongate housing 100. The one or more cover screws 400 can fixedly secure the light module 500 and the cover 300 to the elongate housing 100. The cover screw 400 can enter from behind an upper side of the window 150, or a side of the window 150 closer to the second end 120 of the housing, and be advanced toward the cover 300. The light module 500 can have a screw entry opening 504 located behind the upper side of the window 150 when the light module 500 is installed in the elongate housing 100. Upon reaching the screw post 302 that is located directly above the light module 500, the cover screw 400 can be advanced into the threaded hole on the screw post 302. As shown in FIG. 16, the lighting fixture 10 can be configured to house two light modules 500, with each light module 500 occupying up to a half of the cross-section of the elongate housing 100 between one of the ribs 152 and the T-slot 155 on the same side as the rib 152. The housing 100 can have a second window 150 on the opposite side from the window 150. A second cover screw 400 can enter a screw entry opening 504 on the second light module 500 from behind an upper end of the second window 150, or a side of the window 150 closer to the second end 120 of the housing. Upon reaching the screw post 302 directly above the second light module 500, the second cover screw 400 and be advanced into the threaded hole of the screw post 302. In some embodiments, the cover screw(s) 400 pass through a portion of the housing 100 and into the cover 300 without interfacing with the light module(s) 500.

As described above, the cover screw(s) 400 can be the only fastener(s) that can be accessed from outside the elongate housing 100. The exposed cover screw(s) 400 are well-hidden from plain view as the screw head(s) are placed in inconspicuous locations, such as behind an upper side of the window(s) 150. If the lighting fixture is installed in an upright position, a viewer cannot see the cover screw(s) 400 unless the viewer bends down to look up at the light module(s) 500. Most of the time, the viewer's line of vision is at or above the light module(s) 500. In addition, the cover screw(s) 400 can be difficult to detect because only the small screw head(s) are exposed and placed in such inconspicuous locations.

The lighting fixture can have more than two windows and be configured to house more than two light modules. For example, the lighting fixture can have a circular or triangular cross-section and house three light modules that are radially spaced 120° from one another or that occupy each side of the triangle. The lighting fixture can have a circular or square cross-section and house four light modules that are radially space 90° from one another or that occupy each side of the square.

FIGS. 15 and 16 illustrate light module(s) 500 with an optical transmission surface 501 tilted toward the first end 110 of the housing to direct the light toward the first end 110 from the window(s) 150. The optical transmission surface 501 can be flat. In some embodiments, the optical transmission surface 501 is concave, convex, or otherwise shaped to direct light in a desired pattern. A reflective surface 502 can direct a portion of the light emitting from the optical transmission surface 501 to illuminate a larger area away from the fixture 10. In some embodiments, the reflective surface 502 is concave, flat, convex, and/or some other combination of surface shapes and features. The light modules can have an optical transmission surface 501 that is tilted in other orientations, such as toward the second end 120 of the housing to project light toward the second end 120. A concave reflective surface 502 can provide more surface area for projecting light than other surface shapes.

As shown in FIG. 13, the underside of the cover 300 can optionally include an alignment post 308 at or near a geometric center of the underside of the cover 300. As shown in FIGS. 14B, 14D, and 15, the alignment post 308 can be configured to fit into an alignment hole 358 that is at or near a geometric center of the second mounting bracket 350. When placing the cover 300 onto the elongate housing 100 in a tilted manner, such as shown in FIGS. 14A-14B, the alignment post 308 can align with and be inserted into the alignment hole 358 of the second mounting bracket 350 to guide the placement of the cover 300, and to provide a pivoting point for rotating the cover 300 relative to the elongate housing 100.

The lighting fixtures described herein can be assembled from modular components that can be easily exchangeable. For example, different light modules can be installed in the same lighting fixture. The number of light modules in the lighting fixture can be varied. In addition, if a lighting fixture of a different height are needed, most of the components of the same first and second subassemblies can be re-used, and only the elongate housing, and in some cases the locking screws, need to be changed or modified to vary the height of the lighting fixture.

FIGS. 17-40 illustrate various embodiments of lighting fixtures. Each of the housing of the lighting fixtures is shown with a symbolic break in its length, represented by break lines. The appearance of any portion of the lighting fixtures between the break lines forms no part of the design. Various attributes of the lighting fixtures are shown in broken lines to illustrate that they may or may not be present and that their position, orientation, shape, style, number, etc. can be different according to the different embodiments. The broken lines form no part of the design. For example, FIGS. 17-24 show a lighting fixture with a second window in broken lines. The second window is shown in broken lines to indicate that the second window may or may not be present and the position, orientation, shape, etc. of the second window may differ according to the different embodiments. As another example, FIGS. 17-40 show lighting fixtures with almost the entire lower mounting features in broken lines. Dot-dash lines are used to illustrated boundary lines and form no part of the claimed design. It will be understood that any suitable features for mounting the lighting fixtures onto a mounting surface can be used.

Although this disclosure has been described in the context of certain embodiments and examples, it will be understood by those skilled in the art that the disclosure extends beyond the specifically disclosed embodiments to other alternative embodiments and/or uses and obvious modifications and equivalents thereof. In addition, while several variations of the embodiments of the disclosure have been shown and described in detail, other modifications, which are within the scope of this disclosure, will be readily apparent to those of skill in the art. It is also contemplated that various combinations or sub-combinations of the specific features and aspects of the embodiments may be made and still fall within the scope of the disclosure. For example, features described above in connection with one embodiment can be used with a different embodiment described herein and the combination still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this invention may comprise, additional to its essential features described herein, one or more features as described herein from each other embodiment of the invention disclosed herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. Additionally, as used herein, "gradually" has its ordinary meaning (e.g., differs from a non-continuous, such as a step-like, change).

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A lighting fixture, comprising:

an elongate housing having a first end and a second end;

a first mounting bracket configured to be secured at or near the first end of the elongate housing;

a second mounting bracket configured to be secured at or near the second end of the elongate housing;

at least one light module configured to be housed within the elongate housing; and a cover configured to be secured to the elongate housing by rotating the cover relative to the elongate housing to engage at least one retention member and by a cover fastener, the cover blocking access to an interior of the elongate housing from the second end;

wherein when the lighting fixture is installed, access to the interior of the elongate housing through the first end of the elongate housing is blocked by a mounting surface, wherein the elongate housing comprises a window configured for emitting light from the at least one light module, and wherein the cover fastener is configured to enter the elongate housing from behind the window.

2. The lighting fixture of claim 1, wherein the cover fastener is the only fastener accessible from outside the elongate housing.

3. The lighting fixture of claim 1, further comprising one or more elongate locking screws configured to prevent rotation of the elongate housing relative to the mounting surface, the one or more elongate locking screws at least partially spanning a length of the elongate housing.

4. The lighting fixture of claim 1, wherein the first mounting bracket is mechanically secured to the mounting surface via an installation base bolted to the mounting surface, and wherein the first mounting bracket is rotatably connected to the installation base.

5. The lighting fixture of claim 1, wherein the cover fastener is configured to lock the cover and the at least one light module to the elongate housing.

6. The lighting fixture of claim 1, wherein the first and second mounting brackets are configured to be slidable within the elongate housing along a length of the elongate housing.

7. The lighting fixture of claim 1, wherein the cover comprises a threaded hole on an under side of the cover, the threaded hole configured to receive the cover fastener.

8. The lighting fixture of claim 1, wherein the at least one retention member comprises one or more retaining clips on an internally-facing side of the cover, the one or more retaining clips configured to engage the second mounting bracket.

9. The lighting fixture of claim 1, comprising two or more light modules.

10. A lighting fixture, comprising:

an elongate housing having a first end and a second end;

at least one light module, the elongate housing configured to house the at least one light module, the elongate housing further comprising a non-transparent material and a light-transmissive window configured for emitting light from the at least one light module;

a first mounting bracket configured to be secured at or near the first end of the elongate housing, wherein the first mounting bracket secured to the elongate housing is configured to be rotationally secured to an installation base;

a second mounting bracket configured to be secured at or near the second end of the elongate housing;

one or more elongate locking screws configured to prevent rotation of the elongate housing relative to a mounting surface, the one or more elongate locking screws spanning at least partially a length of the elongate housing; and a cover configured to be secured to the second end of the elongate housing by at least one cover fastener so as to block access to an interior of the elongate housing from the second end of the elongate housing;

wherein when the lighting fixture is installed, access to the interior of the elongate housing from the first end of the elongate housing is blocked by the mounting surface.

11. The lighting fixture of claim 10, wherein the at least one cover fastener is configured to enter the elongate housing from behind the light-transmissive window.

12. The lighting fixture of claim 10, wherein the at least one cover fastener is the only fastener accessible from outside the elongate housing.

13. A method of assembling a lighting fixture, the lighting fixture having one or more mounting fasteners accessible from outside a housing of the lighting fixture and not readily visible to a viewer, the housing having first and second ends, the method comprising:

securing a mounting base to a flat mounting surface;

securing the housing to a first mounting bracket at or near the first end of the housing;

securing the first mounting bracket to the mounting base by rotating the housing relative to the mounting base so as to block access to an interior of the housing from the first end;

installing a locking screw located internal to the housing to prevent rotation of the housing relative to the mounting base;

sliding at least one light module inside the housing;

using fasteners located internal to the housing, securing a second mounting bracket to the housing;

using a cover to block access to the interior of the housing from the second end of the housing; and using at least one cover fastener, securing the cover to the housing from outside the housing.

14. The method of claim 13, wherein the at least one cover fastener is the only fastener accessible from outside the housing.

15. The method of claim 13, wherein using the cover to block access to the interior of the housing from the second end comprises engaging one or more retaining clips on an under side of the cover with corresponding one or more indents on the second mounting bracket.

16. The method of claim 13, further comprising using at least one cover fastener, securing the at least one light module to the cover.

17. The method of claim 13, further comprising sliding two or more light modules into the housing.

18. A lighting fixture, comprising:

an elongate housing having a first end and a second end;

a first mounting bracket configured to be secured at or near the first end of the elongate housing;

a second mounting bracket configured to be secured at or near the second end of the elongate housing;

at least one light module configured to be housed within the elongate housing; and a cover configured to be rotatably secured to the elongate housing by at least one retention member and by a cover fastener, the cover blocking access to an interior of the elongate housing from the second end;

wherein when the lighting fixture is installed, access to the interior of the elongate housing through the first end of the elongate housing is blocked by a mounting surface, wherein the elongate housing comprises a window configured for emitting light from the at least one light module, and wherein the cover fastener is configured to enter the elongate housing from behind the window such that the cover fastener is hidden from plain view when a viewer's line of sight is above the at least one light module.

19. A lighting fixture, comprising:

an elongate housing having a first end and a second end;

a first mounting bracket configured to be secured at or near the first end of the elongate housing;

at least one light module configured to be housed within the elongate housing;

a cover configured to be rotatably secured to the elongate housing by at least one retention member and by a cover fastener, the cover blocking access to an interior of the elongate housing from the second end; and one or more elongate locking screws configured to prevent rotation of the elongate housing relative to a mounting surface, the one or more elongate locking screws at least partially spanning a length of the elongate housing;

wherein when the lighting fixture is installed, access to the interior of the elongate housing through the first end of the elongate housing is blocked by the mounting surface.

20. A lighting fixture, comprising:

an elongate housing having a first end and a second end;

a first mounting bracket configured to be secured at or near the first end of the elongate housing;

at least one light module configured to be housed within the elongate housing; and a cover configured to be rotatably secured to the elongate housing by at least one retention member and by a cover fastener, the cover blocking access to an interior of the elongate housing from the second end;

wherein when the lighting fixture is installed, access to the interior of the elongate housing through the first end of the elongate housing is blocked by a mounting surface, and wherein the cover fastener is configured to lock the cover and the at least one light module to the elongate housing.

21. A lighting fixture, comprising:

an elongate housing having a first end and a second end;

a first mounting bracket configured to be secured at or near the first end of the elongate housing;

a second mounting bracket configured to be secured at or near the second end of the elongate housing with fasteners located internal to the elongate housing;

at least one light module configured to be housed within the elongate housing; and a cover configured to be rotatably secured to the elongate housing by at least one retention member and by a cover fastener, the cover blocking access to an interior of the elongate housing from the second end;

wherein when the lighting fixture is installed, access to the interior of the elongate housing through the first end of the elongate housing is blocked by a mounting surface, and wherein the first and second mounting brackets are configured to be slidable within the elongate housing along a length of the elongate housing.

22. The lighting fixture of claim 1, wherein the window is light-transmissive.

23. The lighting fixture of claim 1, wherein the window is an aperture in the elongate housing.

* * * * *